US012642326B2

(12) United States Patent
Scharpenack et al.

(10) Patent No.: US 12,642,326 B2
(45) Date of Patent: Jun. 2, 2026

(54) INNER SYSTEM FOR A SAFETY HELMET

(71) Applicants: Ulbrichts GmbH, Schwanenstadt (AT); Markus Rieger, Atzbach (AT)

(72) Inventors: Georg Scharpenack, Altmünster (AT); Nicolas Fellin, Neuhofen im Innkreis (AT); Franz Rieger, Atzbach (AT); Walter Grötzl, Schwanenstadt (AT)

(73) Assignee: Ulbrichts GmbH, Schwanenstadt (AT)

( * ) Notice: Subject to any disclaimer, the term of this patent is extended or adjusted under 35 U.S.C. 154(b) by 0 days.

(21) Appl. No.: 18/729,367

(22) PCT Filed: Jan. 17, 2023

(86) PCT No.: PCT/EP2023/050994
§ 371 (c)(1),
(2) Date: Jul. 16, 2024

(87) PCT Pub. No.: WO2023/135331
PCT Pub. Date: Jul. 20, 2023

(65) Prior Publication Data

US 2025/0089838 A1 Mar. 20, 2025

(30) Foreign Application Priority Data

Jan. 17, 2022 (EP) ..... 22151768

(51) Int. Cl.
*A42B 3/14* (2006.01)
*A42B 3/06* (2006.01)

(52) U.S. Cl.
CPC ..... *A42B 3/145* (2013.01); *A42B 3/062* (2013.01)

(58) Field of Classification Search
CPC ..... A42B 3/145; A42B 3/062
See application file for complete search history.

(56) References Cited

U.S. PATENT DOCUMENTS 3,092,837 A * 6/1963 Austin ..... A42B 3/145 2/419
3,154,788 A * 11/1964 Simpson ..... A42B 3/145 2/418
3,510,879 A * 5/1970 Webb ..... A42B 3/14 2/416

(Continued)

FOREIGN PATENT DOCUMENTS

EP 4212050 A1 * 7/2023 ..... A42B 3/062
WO WO-97/37553 A1 10/1997

(Continued)

*Primary Examiner* — Khaled Annis
(74) *Attorney, Agent, or Firm* — MARSHALL, GERSTEIN & BORUN LLP; Randall G. Rueth

(57) ABSTRACT

The present invention relates to an inner system (10) for a protective helmet (1), comprising: (a) a substantially circumferential headband (11), the circumference of the headband (11) being variably adjustable, (b) at least a first (14*a*), a second (14*b*) and a third (14*c*) tab, the headband (11) being connected to the at least three tabs, and (c) at least a first (12*a*), a second (12*b*) and a third (12*c*) adhesive element, wherein the first adhesive element (12*a*) is adapted to be connected to the first tab (14*a*), wherein the second adhesive element (12*b*) is adapted to be connected to the second tab (14*b*), and wherein the third adhesive element (12*c*) is adapted to be connected to the third tab (14*c*).

10 Claims, 10 Drawing Sheets

(56) References Cited

Figure 1A:
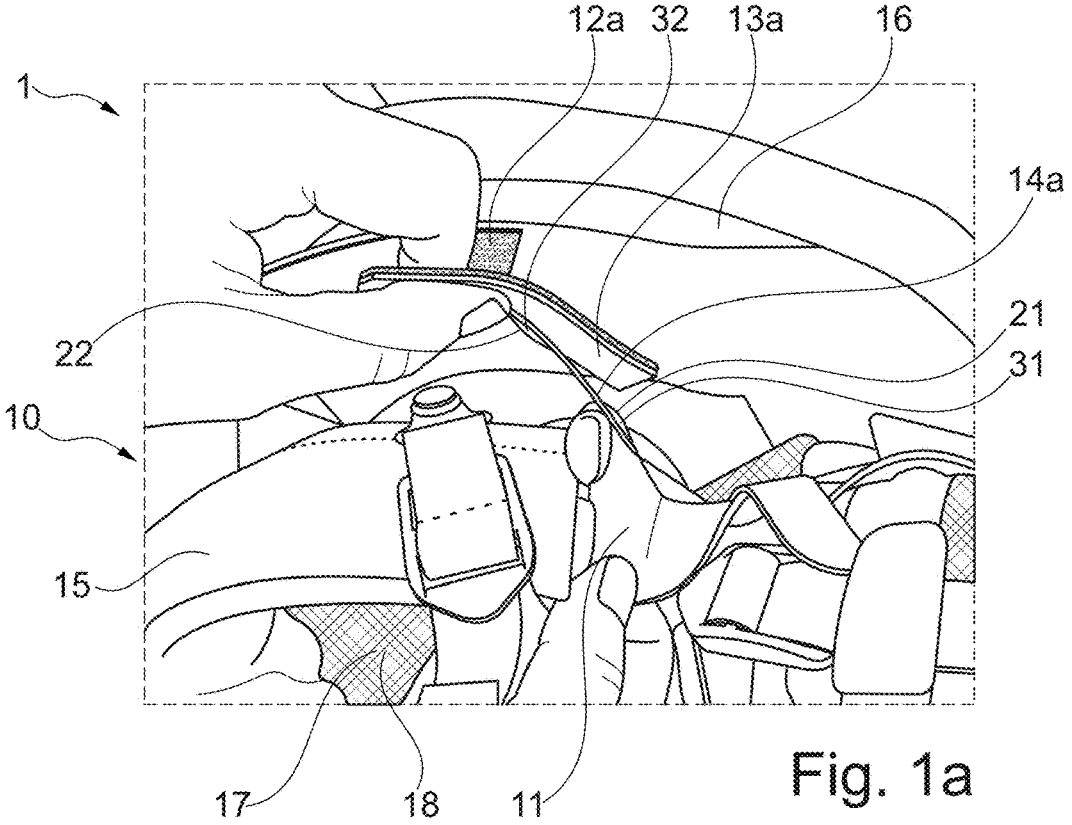

U.S. PATENT DOCUMENTS 3,696,441 A * 10/1972 Littleton ..... A42B 3/145 2/418
3,714,668 A * 2/1973 Mirabella ..... A42B 3/145 2/419
3,758,889 A * 9/1973 Erb ..... A42B 3/145 2/416
3,787,641 A * 1/1974 Santori ..... H04R 1/46 381/151
3,994,023 A * 11/1976 Aileo ..... A42B 3/14 2/419
4,056,852 A * 11/1977 Greendale ..... A42B 3/145 2/909
4,131,953 A * 1/1979 Kimotsuki ..... A42B 1/205 2/171.1
4,287,613 A * 9/1981 Schulz ..... A42B 3/122 2/420
4,765,338 A * 8/1988 Turner ..... A61F 7/02 607/114
4,833,735 A * 5/1989 Long ..... A42B 3/145 2/419
4,993,079 A * 2/1991 Johnson ..... A42B 7/00 2/418
5,113,534 A * 5/1992 Lane ..... A42B 3/145 2/5
5,142,705 A * 9/1992 Edwards ..... A42B 3/145 2/418
5,150,479 A * 9/1992 Oleson ..... A42B 3/14 2/5
5,704,072 A * 1/1998 Garneau ..... A61P 17/00 24/442
5,898,949 A * 5/1999 Barthold ..... A42B 3/10 2/5
6,032,297 A * 3/2000 Barthold ..... A42B 3/10 2/418
7,174,575 B1 * 2/2007 Scherer ..... A42B 3/145 2/418
7,213,271 B1 * 5/2007 Bielefeld ..... A42B 3/145 2/416
7,770,239 B1 * 8/2010 Goldman ..... A42B 3/142 2/418
9,307,802 B2 * 4/2016 Hall ..... A42B 3/145
10,512,294 B2 * 12/2019 de la Fuente ..... A42B 3/121
10,729,201 B1 * 8/2020 de la Fuente ..... A63B 71/10
11,096,439 B2 * 8/2021 King ..... A42B 3/145
2003/0106138 A1 * 6/2003 Guay ..... A42B 3/145 2/418
2004/0039318 A1 * 2/2004 Santelli, Jr. ..... A61F 5/055 602/18
2004/0163160 A1 * 8/2004 Oleson ..... A42B 3/14 2/410
2005/0217006 A1 * 10/2005 Sutter ..... A42B 3/08 2/416
2006/0015986 A1 * 1/2006 Bielefeld ..... A42B 3/145 2/181
2006/0048285 A1 * 3/2006 Bielefeld ..... A42B 3/145 2/416
2006/0206994 A1 * 9/2006 Rogers ..... A42B 3/145 2/418
2009/0320186 A1 * 12/2009 Petzl ..... A42B 3/145 2/417
2010/0024097 A1 * 2/2010 Saenim ..... A42B 3/003 2/411
2013/0191973 A1 * 8/2013 Pfanner ..... A42B 3/08 2/421
2014/0109301 A1 * 4/2014 Hall ..... A42B 3/142 2/416
2015/0059066 A1 * 3/2015 Ketterer ..... A42B 3/324 2/418
2016/0324246 A1 * 11/2016 de la Fuente ..... A61B 5/7282
2018/0042330 A1 * 2/2018 Wu ..... A42B 3/225
2020/0121014 A1 * 4/2020 King ..... A42B 3/08
2020/0121017 A1 * 4/2020 King ..... A42B 3/14
2021/0337911 A1 * 11/2021 Franke ..... A42B 3/14
2022/0039502 A1 * 2/2022 Brose ..... A42B 3/142
2025/0089838 A1 * 3/2025 Scharpenack ..... A42B 3/062

FOREIGN PATENT DOCUMENTS

WO WO-9945807 A1 * 9/1999 ..... A42B 3/14
WO WO-2014/055722 A1 4/2014
WO WO-2015/065902 A1 5/2015
WO WO-2020094869 A1 * 5/2020 ..... A42B 3/064

* cited by examiner

INNER SYSTEM FOR A SAFETY HELMET

CROSS-REFERENCE TO RELATED APPLICATIONS

This application is a national stage application, filed under 35 U.S.C. § 371, of International Application No. PCT/EP2023/050994, filed Jan. 17, 2023 and entitled "Inner System For A Safety Helmet," which claims priority to European Application No. 22151768.3, filed Jan. 17, 2022 in the European Patent Office, the disclosures of which are incorporated by reference herein in their entireties.

1. TECHNICAL AREA

The present invention relates to an inner system for a protective helmet, in particular a ballistic protective helmet or an impact protection helmet, and a corresponding protective helmet.

2. STATE OF THE ART

Protective helmets, especially ballistic helmets and impact protection helmets, are used in a wide range of police and military applications. They protect the wearer from head injuries caused by indirect or direct fire and splinters or from blunt head injuries caused by impact.

An inner system of a protective helmet is intended to ensure an optimum fit of the protective helmet. Inner systems for protective helmets are known from WO 2014/055722 A1 and WO 2015/065902 A1. It is of crucial importance for effective protection that the protective helmet always has a centered fit, regardless of the wearer's head size. This cannot be achieved with the existing inner systems. On the contrary, with inner systems as known from the prior art, a protective helmet often has a rear-heavy fit for medium-sized and smaller heads and the head is shifted forwards when the size is adjusted. As a result, the helmet sits unbalanced and insecure, so that an optimum protective effect cannot be achieved.

In the prior art, it is also known to adjust the size of a protective helmet using interchangeable pads. Some suppliers also offer helmets in different sizes. In practice, this has proven to be time-consuming and cost intensive. For example, in some regions protective helmets are assigned to a police vehicle and not to a police officer. If the vehicle is shared by police officers with different head sizes, then the helmet size would either have to be adjusted at the beginning of each police operation, which is time-consuming, or it would be necessary to carry a large number of helmets of different sizes. This has proven to be disadvantageous, so that it is an object of the present invention to provide a protective helmet which can be manufactured in a uniform size, which can be quickly adapted to the individual head size and head shape of a wearer and yet always provides an optimum fit, i.e. in particular a central fit.

However, the protective effect of such helmets is often limited by critical weak points. In the prior art, inner systems were attached to the helmet dome by means of bolts or screws engaging in the helmet dome. One finding underlying the present invention is that such bolts or screws engaging in the helmet dome reduce the protective effect of the helmet. Thus, a bolt or screw can become a secondary projectile when the helmet is hit, which can seriously injure the head. Furthermore, although the material of a bullet is a solid, it behaves like a liquid at high speeds and under the high pressures that occur on impact. On impact, the bullet can therefore "trickle through" even small gaps between the bolt/screw and the bore or thread in the dome and thus also seriously injure the head of the wearer directly.

A further object of the present invention is therefore to improve the protective effect of a protective helmet.

3. SUMMARY OF THE INVENTION

These objects are met by the subject matter of the independent claims.

One aspect of the invention relates to an inner system for a protective helmet, comprising:

(a) a substantially circumferential headband, the circumference of the headband being variably adjustable, (b) at least a first, a second and a third tab, wherein the headband is connected to the at least three tabs, and (c) at least a first, a second and a third adhesive element, wherein the first adhesive element is adapted to be connected to the first tab, wherein the second adhesive element is adapted to be connected to the second tab, and wherein the third adhesive element is arranged to be connected to the third tab.

An inner system according to the invention prevents the head from being pushed forward when the size is adjusted, as the headband is essentially circumferential. As a result, the wearer's head is essentially clamped from all sides when adjusting the size. This means that an ideal fit (Best Fit) with a centered fit (Best Balance) can be achieved, even if the helmet itself is only available in one size (One Size Fits All). Furthermore, no replacement pads are required to adjust the size. The size can also be adjusted very quickly (Quick Size System).

In the present context, the term "essentially" means that the headband is designed to be circumferential, with the exception of insignificant intermediate elements, such as padding elements or adjustment elements. As a rule, "substantially circumferential" therefore means circumferential over at least 65%, preferably 75%, of the circumference of an oval shape around which the headband is placed.

The headband preferably has a width of at least 1 cm, preferably at least 1.5 cm, more preferably at least 2 cm. This ensures a stable fit on the wearer's head.

The headband may comprise leather or imitation leather, or a synthetic material. The headband can be knitted, warp-knitted or woven, or comprise a non-woven material. For example, the headband may be covered with leather or synthetic leather and a core of the headband may comprise a flexible polymer (plastic). This combination is particularly comfortable and durable.

The adhesive elements can be spatially and physically separated from each other. It is possible for the adhesive elements to overlap, but gaps can also be formed between the adhesive elements. In addition, several adhesive elements (a plurality of adhesive elements) can also be designed as one integral adhesive element. The designations first, second and third adhesive element are only used to differentiate the corresponding area.

The protective helmet can, for example, be a ballistic protective helmet or an impact protection helmet. The described advantages of the invention have a particularly great effect on ballistic protective helmets and impact protection helmets. In particular, however, completely different problems arise with ballistic protective helmets and impact protection helmets than is the case, for example, with lighter helmets, such as bicycle helmets or helmets such as are usually worn on construction sites. In particular, balance is less important with lighter helmets than it is with a (in many cases heavier) ballistic or impact protection helmet. Concepts known from bicycle helmets or "construction site helmets" can therefore not be easily transferred to ballistic protective helmets and impact protection helmets.

An adhesive element is an element that can be attached to another object by means of an adhesive connection. An adhesive connection can be an adhesive bond, for example. The first, second or third adhesive element can be used to attach the inner system to a helmet dome via an adhesive connection.

The first, second, third or any other tab can be elongated. This enables optimum access to the adhesive element.

The first, second, third, or any further tab may be integrally formed with or attached to the headband, for example by means of a rivet, a seam, a hook and loop fastener, or by other means. Further, a first, second, third, or any other tab may be welded to the headband (e.g., by a plastic/ultrasonic welding process). All three embodiments (integral shaping, fastening or welding) fall under the term "connected". Fastening makes it particularly easy to replace defective components. An integral or welded design, on the other hand, is particularly resistant and durable.

It is possible that none of the tabs comprises an engagement or reach-through element or a receptacle formed for an engagement or reach-through element. An engagement or reach-through element can comprise a bolt, a screw, a rivet or similar, in particular for engaging or reaching into or through a helmet dome.

This means that it is possible to attach the inner system to the helmet dome without an engagement or penetration element. This improves the safety of the protective helmet, as an engaging or penetrating element can become a secondary projectile when the helmet is hit, which can seriously injure the head.

In a first alternative, it is possible that the first adhesive element can be connected to the first tab in a detachable adhesive connection, wherein furthermore the second adhesive element can be connected to the second tab in a detachable adhesive connection and wherein furthermore the third adhesive element can be connected to the third tab in a detachable adhesive connection.

A detachable adhesive connection can include a hook-and-loop fastener, for example. This means that hard connecting elements such as rivets can also be avoided in the interior of a dome (i.e. not only as an engagement or penetrating element in or through a dome). This can improve the comfort of the protective helmet. A surprising finding of the inventors is that even with heavy protective helmets, a detachable adhesive connection can be sufficiently strong so that the protective helmet can remain on the wearer's head even under great stress, for example in the event of a stroke or under fire.

In a second alternative, the first adhesive element can be positively connected to the first tab, wherein furthermore the second adhesive element can be positively connected to the second tab and wherein furthermore the third adhesive element can be positively connected to the third tab. A form-fit connection can comprise a rivet. This second alternative enables a particularly resistant connection of the adhesive element to the strap and is particularly suitable for especially challenging applications with high force effects on the protective helmet, for example in the event that heavy caliber fire is to be expected.

It is possible that the circumference of the headband can be adjusted by an adjustment system, whereby the adjustment system is operated by a rotary knob. The adjustment system can, for example, comprise a gear and/or a toothed rack. This allows the user to easily adjust the circumference of the headband to the size of their own head. For example, this can be done blindly and with one hand, i.e. without having to remove the helmet. The adjustment system can be located at the back of the head. This enables easy access and effective adjustment.

It is possible that the first tab comprises a first connection point, wherein the headband is connected to the first tab at the first connection point; wherein the first tab further comprises a second connection point, wherein the first tab is adapted to be connected to the first adhesive member at the second connection point, and wherein the first connection point is spaced apart from the second connection point so that the headband can be floatingly attached to the first adhesive member via the first tab.

This arrangement relates to a particularly advantageous embodiment of the present invention. By spacing the first connection point and the second connection point, a floating attachment of the headband in the first adhesive element can be achieved. A similar connection is correspondingly possible for the second and third adhesive elements. In other words:

It is possible that the second tab comprises a third connection point, wherein the headband is connected to the second tab at the third connection point; wherein the second tab further comprises a fourth connection point, wherein the second tab is adapted to be connected to the second adhesive member at the fourth connection point, and wherein the third connection point is spaced from the fourth connection point so that the headband can be floatingly attached to the second adhesive member via the second tab.

It is possible that the third tab has a fifth connection point, wherein the headband is connected to the third tab at the fifth connection point; wherein the third tab further has a sixth connection point, wherein the third tab is adapted to be connected to the third adhesive member at the sixth connection point, and wherein the fifth connection point is spaced from the sixth connection point so that the headband can be floatingly attached to the third adhesive member via the third tab.

If further tabs and corresponding adhesive elements are present, it is of course possible, but not absolutely necessary, that these further tabs and the corresponding adhesive elements are also connected to each other in a floating manner via such an arrangement.

It should be noted that it is possible to connect the first tab directly or indirectly to the first adhesive element at the second connection point. For example, in the case of an indirect connection, a first intermediate element may be present, as described below. The same applies accordingly to the second tab and the third tab or other tabs.

The floating arrangement enables a shock-absorbing effect to be achieved, as a dome is movable in relation to the inner system, as the headband is attached to one or more of the adhesive elements in a floating manner. Furthermore, this achieves an optimum balance (Best Balance) in which the protective helmet is always held in a central position. For example, when the headband is shortened, the headband is pulled towards the wearer's head due to its floating attachment to one or more of the adhesive elements. This ensures that the head is not pulled in a certain direction, for example forwards, when the headband is shortened, which would negatively affect the balance.

It is possible for the first tab to be attached to a first intermediate element at the second connection point and for the first intermediate element to be attached to the first adhesive element in a detachable adhesive connection, so that the first tab can be attached indirectly to the first adhesive element in a detachable adhesive connection. Such an arrangement enables greater flexibility in the design of the inner system. In particular, this allows the inner system to be fastened relatively deep in a helmet dome and ensures a stable hold of the inner system on the spherical cap and on the head of the carrier.

The first tab can be sewn to the first intermediate element at the second connection point. Such a connection is advantageous because it does not include any hard elements that could injure the head of a wearer, yet still allows for a stable and durable connection. The second flap and/or the third flap can be sewn to the second and/or third intermediate element accordingly (namely to the fourth and/or sixth connection point).

Alternatively, it is possible for the first, second and/or third strap to be attached to the first, second and/or third intermediate element at the second, fourth and/or sixth connection point via rivets. This advantageously enables a rotatable connection, which can contribute to greater wearing comfort and better absorption of shocks.

The detachable adhesive connection of the first and/or the second and/or the third adhesive element may comprise a hook-and-loop fastener. The inventors have found that this is a particularly advantageous embodiment. Without limiting the subject matter of the invention, it is believed that a hook-and-loop fastener is highly resistant to lateral forces and is therefore particularly suitable. Although a hook-and-loop connection can relatively easily be released by pulling off an element in a direction perpendicular to the connection interface, such an application of force is very rare when using a protective helmet. If this occurs, then it can generally be assumed that it was deliberately applied by a wearer to adjust the inner system and was not caused unintentionally, for example by the impact of a projectile, which can lead to compressive forces perpendicular to the connection interface, but regularly not to pulling forces that would be required to release the hook-and-loop connection. Lateral impact of a projectile on an edge area of the protective helmet can result in transverse forces, but a hook-and-loop connection is very resistant to these transverse forces.

It is possible that the hook and loop fastener comprises a hook tape and a corresponding fleece tape (or felt tape). For example, the first, second or third adhesive element can comprise a hook tape and the first, second or third intermediate element a corresponding fleece tape. The arrangement can also be reversed. This achieves good adhesion and a flat profile with low weight.

It is also possible that the hook-and-loop connection includes a mushroom-head band and a corresponding velour tape, which enables stronger adhesion.

It is also possible that the hook and loop fastener comprises a mushroom-head strap and a corresponding fleece strap, which provides particularly good resistance to lateral forces.

For applications where the focus is on less mechanical stress and greater comfort, such as protective helmets that are used for longer periods of time in situations with a lower risk potential (e.g. during a peaceful demonstration), the hook-and-loop fastener can comprise extruded hooks or mushrooms on knitted fabric. For example, the first, second or third adhesive element can comprise hooks and the first, second or third intermediate element can comprise knitted fabric. This allows a particularly high level of comfort to be achieved.

The hook-and-loop fastener can include non-flammable materials or be impregnated in such a way that it is non-flammable. This ensures that the wearer's head is protected even in situations with an acute fire hazard.

The inner system can also include a head net. A head net ensures that the distance between the head and the dome above the head is not too large or too small, even when the size is adjusted (an example of Best Fit).

The head net can be attached to the headband. This has the advantage that the head net can be adjusted together with the headband and thus ensures an optimum fit for different head sizes.

The head net can, for example, be arranged in a central area and be completely or partially enclosed by the headband. For example, it is possible that at least a first head net fastening element is attached to the head net or that the head net is integrally formed with the first head net fastening element, wherein the first head net fastening element extends through an opening in the headband. This arrangement has the advantage that the headband can additionally be attached directly to the dome (see below) when the inner system is used in a protective helmet comprising a dome.

The first head net attachment element may comprise a first region and a second region, wherein a releasable adhesive connection may be created between the first and second regions. This releasable adhesive connection may comprise a hook-and-loop connection as described herein. This enables a connection to the headband without a connection to the dome, if this is desired. For example, a particularly high dynamic mobility of the inner system can be achieved in this way, which may be preferred for certain applications.

Of course, several head net fastening elements can be attached to the head net, for example a first, second, third and fourth head net fastening element. It is possible for several head net fastening elements to pass through the same or different openings in the headband.

The head net can also be attached to at least one of the first, second, third or fourth tabs. This has the advantage that the head net can move together with the strap and thus ensures optimum support even during dynamic movement sequences.

The first adhesive element and the corresponding first strap can be arranged on the left side of a protective helmet. The second adhesive element and the corresponding second strap can be designed to be positioned at the rear of a protective helmet. The third adhesive element and the corresponding third strap can be designed for arrangement on a right-hand side of a protective helmet. The fourth adhesive element and the corresponding fourth strap can be designed to be positioned at the front of a protective helmet. It is particularly advantageous if the head net is attached to the second strap (rear) and the fourth strap (front). This ensures the best stability and still allows the head net to move with the size adjustment.

The head net can be at least partially knitted, warp-knitted or woven, or comprise a non-woven material. The head net preferably comprises a plurality of openings so that air can circulate between the wearer's head and the head net.

The head net can comprise a spacer fabric. A spacer fabric is a three-dimensional knitted fabric in which two opposing surfaces are connected by spacer connecting elements. This makes the padding and ventilation particularly effective.

The head net can comprise at least one flat band. A flat band is a textile whose width is considerably greater than its thickness. Preferably, a flat band is at least three times as wide as it is thick, more preferably at least five times as wide as it is thick, most preferably at least ten times as wide as it is thick. This has the advantage that the positioning of the head is improved by the flat band, as this gives the head net additional rigidity.

The head net may comprise at least a first and a second flat band, wherein the first flat band and the second flat band are arranged substantially at right angles to each other. In the present case, substantially at right angles means that two intersecting edges of the first and second flat bands form an angle of between 45° and 135°, more preferably 60° and 120°.

This improves the positioning of the head along two axes, namely along a first longitudinal axis of the first flat belt and a second longitudinal axis of the second flat belt.

The first longitudinal axis can essentially run from front to back. The second longitudinal axis can run essentially from a right side to a left side. Essentially means within the scope of the variations customary in the art for soft components of inner systems for protective helmets, which comprise variations of about 20°.

The first and or second band can have a width of at least 1 cm and at most 6 cm, preferably at least 1.5 cm and at most 5.5 cm, most preferably at least 2 cm and at most 4 cm. The greater the width, the greater the rigidity of the head net. However, excessive rigidity can also be undesirable, as this can reduce the accuracy of fit.

The invention further relates to a protective helmet comprising: (a) a dome, (b) an inner system as described herein, (c) wherein each of the adhesive elements of the inner system is attached to the dome.

The protective helmet therefore benefits from the advantages of the inner system described above. In particular, it offers good balance (Best Balance), a good fit (Best Fit), can be adjusted quickly (Quick Size) and can be produced in a single size and still be used by a variety of people of different head sizes (One Size Fits All).

The protective helmet can be a ballistic protective helmet or an impact protection helmet. Therefore, the dome can be designed to be bullet-resistant or impact-resistant. The term "bullet-resistant" refers to an inhibiting effect against the impact of projectiles or splinters (e.g. shrapnel). The dome can also provide protection against slashing and stabbing weapons.

It is possible for each of the adhesive elements to be attached to the dome without an element engaging or penetrating the dome. This prevents an engaging or penetrating element from developing into a secondary projectile under fire or injuring the head when struck.

Each of the adhesive elements can be attached to the dome via an adhesive connection. As described, this improves the protection of the head against injuries.

The first, second, third or fourth strap can be Y-shaped, i.e. have three connection points. It is possible for the first, second, third or fourth strap to have one connection point to the headband and two connection points to the corresponding adhesive element (also indirectly via an intermediate element). The Y-shaped design has the advantage of creating a torsionally stable connection. As a result, the inner system rotates directly with the rotational movements of the head and does not "slip". This also serves to improve the protective effect by providing a better hold.

The first adhesive element and the corresponding first strap can be arranged on the left side of the protective helmet. The second adhesive element and the corresponding second strap can be arranged at the back of the protective helmet. The third adhesive element and the corresponding third strap can be arranged on a right-hand side of the protective helmet. The fourth adhesive element and the corresponding fourth strap can be arranged at the front of the protective helmet. It is particularly advantageous if the second strap (rear) and the fourth strap (front) are Y-shaped. This secures the helmet particularly effectively against lateral upward and downward movement towards the head position.

If the inner system comprises a head net, the head net can also be attached directly to the dome via at least one first head net fastening element, where "directly" in this context means that the first (and possibly second, third, fourth, etc.) head net fastening element is attached directly to the dome (i.e. not only via intervening objects such as the headband). The headband is not a head net fastening element. This direct attachment to the dome has the advantage that the head net does not move upwards in volume when the headband is reduced all the way round. This results in a better fit and a more stable fit of the protective helmet, which is maintained when the size is adjusted.

The head net can be attached to a left-hand side of the dome via a first head net fastening element and attached to a right-hand side of the dome via a second head net fastening element. The advantage of this attachment is that it is very stable.

The head net can also be attached to a left side of the dome via a third head net fastening element and attached to a right side of the dome via a fourth head net fastening element. In this arrangement, the first head net fastening element can be arranged at the left rear, the second head net fastening element at the right rear, the third head net fastening element at the left front and the fourth head net fastening element at the right front of the dome.

This type of attachment is very torsionally rigid, i.e. stable, even when the head rotates.

At least one of the first, second, third and fourth head net fastening elements can be passed through—respectively—a first, second, third and fourth opening, for example each in the form of a gap, in the headband. For example, the first and second head net fastening elements can be passed through a first and second gap in the headband, respectively.

This has the advantage of simple and space-saving guidance of the head net fastening element(s), even with a complex inner system.

As described above, it is particularly advantageous if the head net is attached to the second flap (rear) and the fourth flap (front). This has the unexpected synergistic effect of further stabilizing the inner system as a whole without negatively affecting the adaptability to different head sizes even further.

The protective helmet can also include a shock absorber ring. The damping ring may cover a part of the headband on an inner side, i.e. the side facing the head. It is possible that the damping ring only covers a part of the headband. Preferably, the damper ring covers at least 30%, more preferably at least 50%, most preferably at least 60% of the headband. The damper ring is therefore not necessarily circumferential. However, the cushioning ring can be circumferential in order to offer maximum comfort. The damping ring significantly improves the wearing comfort and protective effect of the protective helmet.

It is possible that the damper ring is attached to the headband. This has the advantage that the headband is always (at least partially) covered by the shock absorber ring, even when the headband is adjusted. The damping ring can comprise a foam material. The cushioning ring can, for example, comprise ethylene-vinyl acetate copolymers, EVA. This offers advantageous damping properties and low abrasion.

The damper ring can have a large number of ventilation cams and protrusions, which are arranged alternately. This improves the ventilation of the head and thus the wearing comfort.

The protective helmet may further comprise a harness system, wherein the harness system is attached to the dome via a detachable adhesive connection. A further advantage of the present invention is that the harness system can be designed independently of the inner system. In other words, the harness system is basically attached to the dome at different points than the inner system. This advantageously increases the adjustment options for the wearer. The detachable adhesive connection of the system improves the protection of the head against injuries, as described.

The harness system can include:

(a) a left rear strap,
(b) a right rear strap,
(c) a left front strap,
(d) a right front strap, and
(e) a chin region in which the left rear strap, the right rear strap, the left front strap and the right front strap are releasably connected to each other so that the harness system can be opened.

The left/right, top/bottom, front/rear positions are always described from the wearer's perspective and not from the perspective of a third party looking at the helmet from the outside.

This design enables a stable fit of the protective helmet and versatile adjustment options for the wearer.

It is possible that each of the described straps can be adjusted separately in length.

It is also possible for the harness system to comprise a Y-shaped harness in which a strap is attached to the rear area of the helmet dome, which splits into a left and right strap towards the front area of the helmet dome.

A fastener can be attached in the chin area. To increase comfort and prevent the fastener from rubbing against the skin, a pad, such as a piece of leather, can be attached under the fastener.

A pad, for example a piece of leather, can also be attached under the left and right front straps to further increase comfort.

It is also possible that a pad, for example a piece of leather, is fitted under the rotary knob of the adjustment system, which is used to adjust the circumference of the headband.

Each of the aforementioned padding elements, in particular a left upper padding element, a right upper padding element, a rear and/or a front padding element, can comprise a ventilation channel. This has the advantage of improving ventilation and thus wearing comfort.

The dome can include titanium. Titanium provides excellent protection while being lightweight. The applicant has succeeded in optimizing the manufacturing process for domes comprising titanium to such an extent that they are suitable for practical use.

It is also possible for the dome to comprise PE-titanium, aramid-titanium, PE-carbon-aramid or similar hybrid configurations. PE stands for polyethylene. These enable a lower weight.

4. BRIEF DESCRIPTION OF THE FIGURES

Figure 1B:
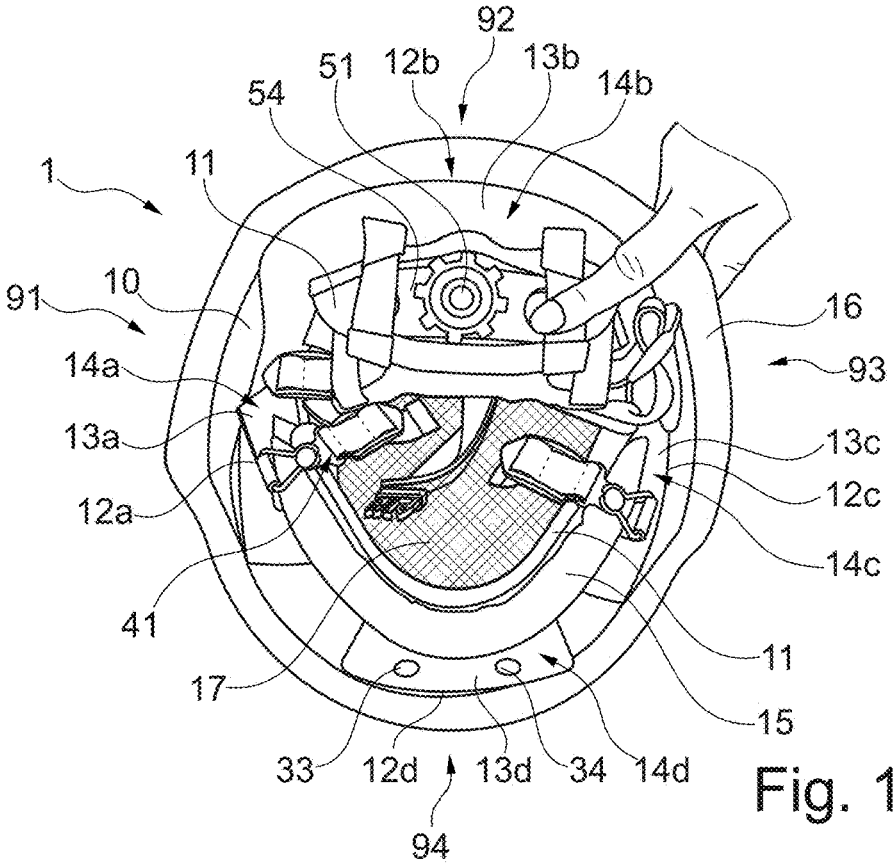

FIG. 1*a* shows a section of a protective helmet according to the invention, FIG. 1*b* shows a view from below of the protective helmet in FIG. 1*a;*

Figure 3A:
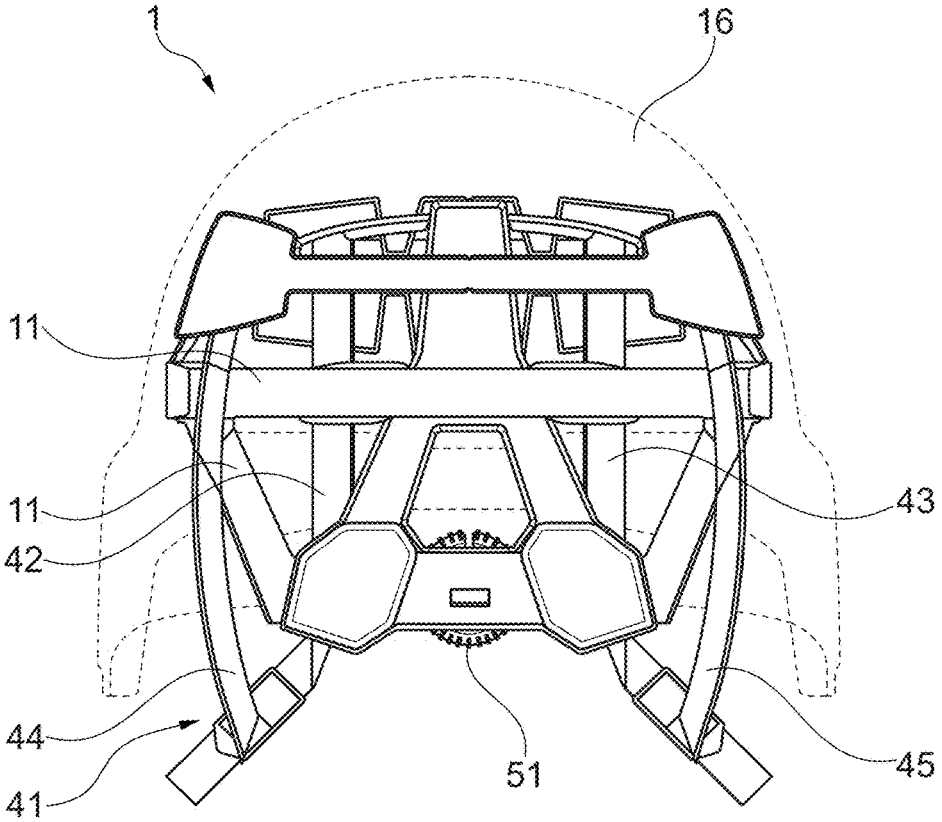
Figure 3B:
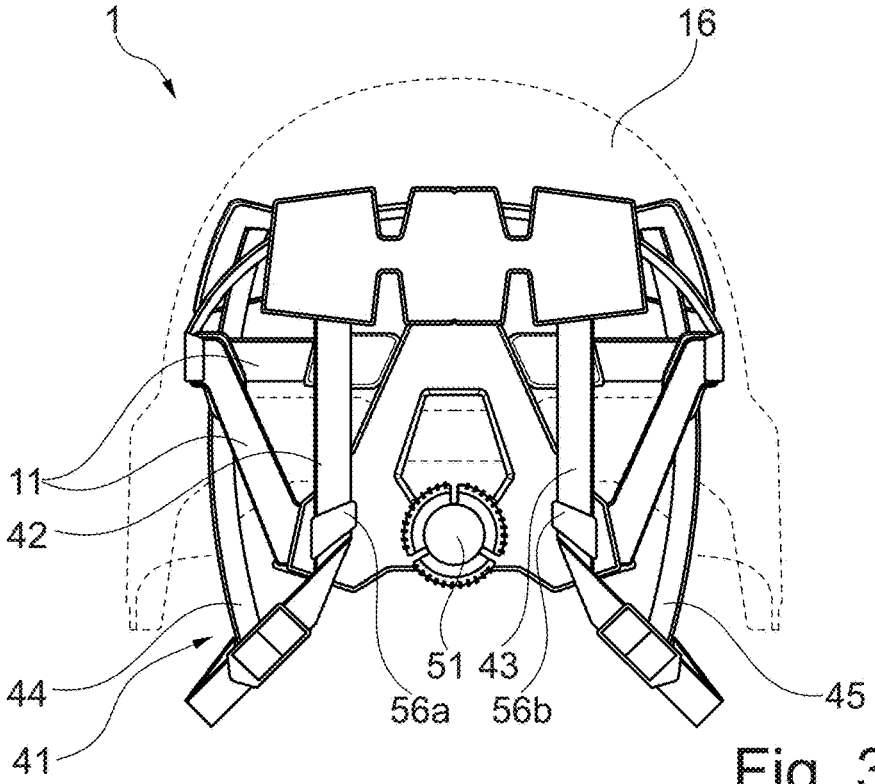

FIGS. 2*a* to 2*e* show an embodiment of a protective helmet according to the invention;

FIG. 3*a* shows a front view from the front to the rear of a protective helmet according to the invention, FIG. 3*b* shows a rear view of the protective helmet in FIG. 3*a,*

Figure 3C:
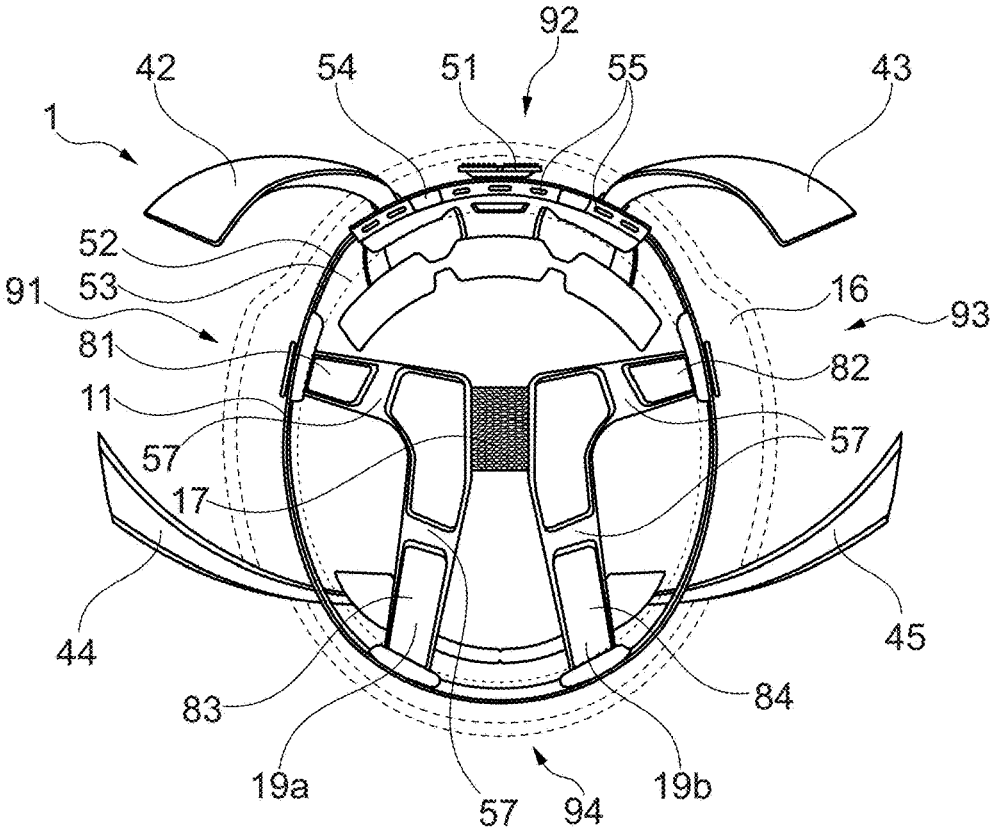

FIG. 3*c* shows a top view of the protective helmet of FIGS. 3*a* and 3*b,*

Figure 3D:
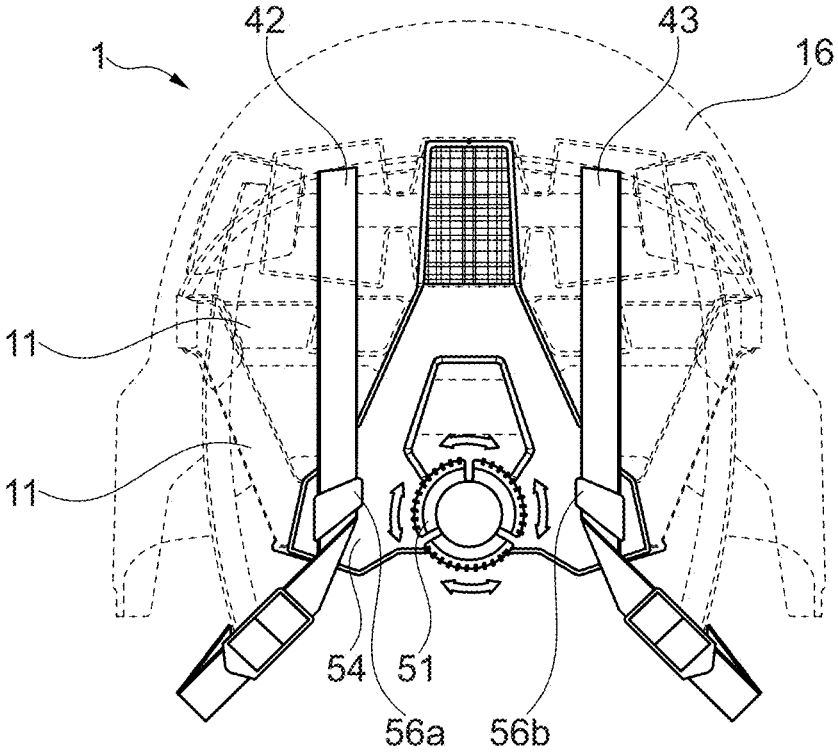

FIG. 3*d* shows a rear view of the protective helmet of FIGS. 3*a* to 3*c,*

Figure 3E:
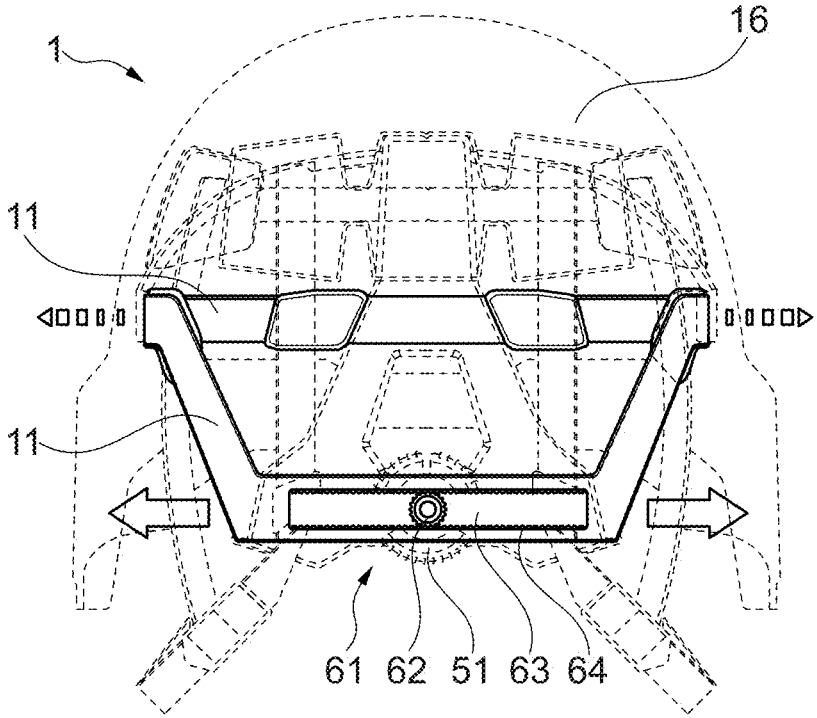

FIG. 3*e* shows a front view of the protective helmet in FIGS. 3*a* to 3*d,*

Figure 3F:
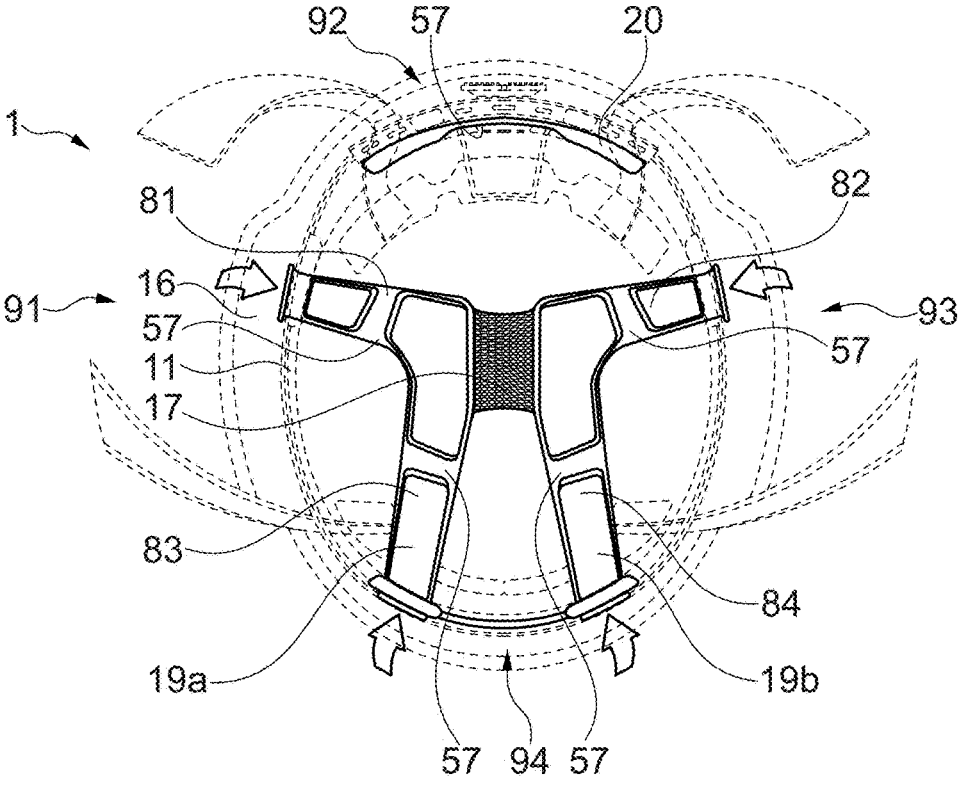

FIG. 3*f* shows a top view of the protective helmet of FIGS. 3*a* to 3*e,*

Figure 3G:
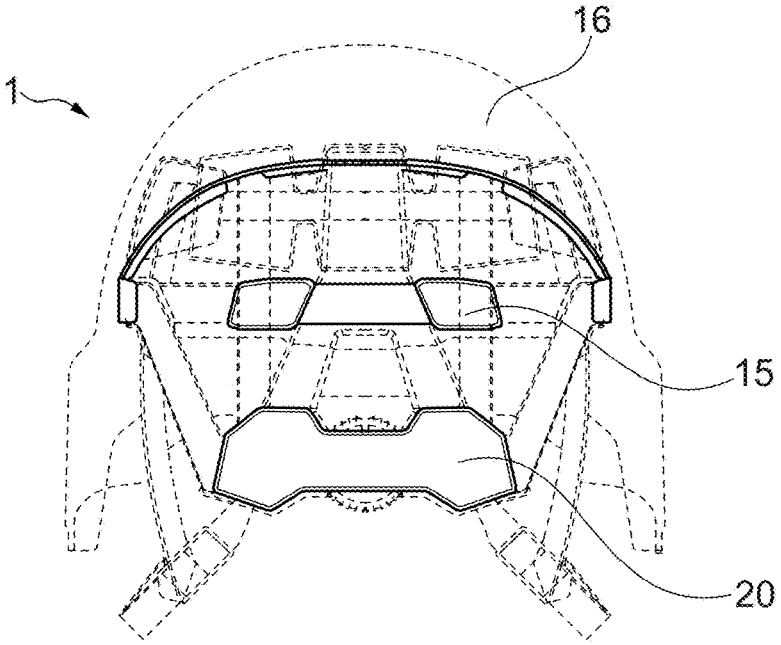

FIG. 3*g* shows a rear view of the protective helmet of FIGS. 3*a* to 3*f;*

Figure 4A:
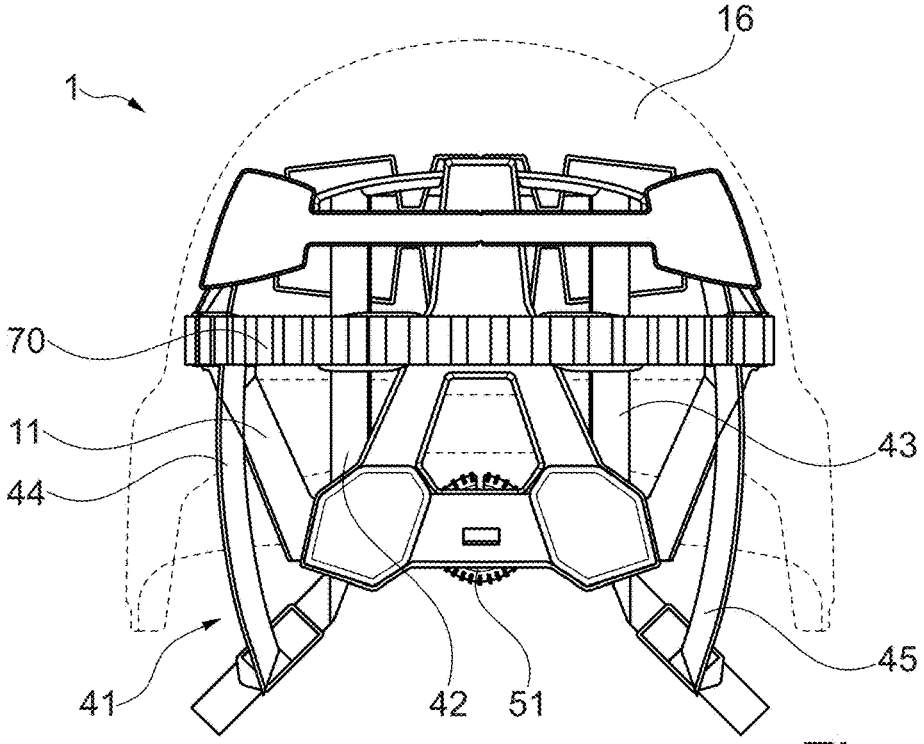
Figure 4B:
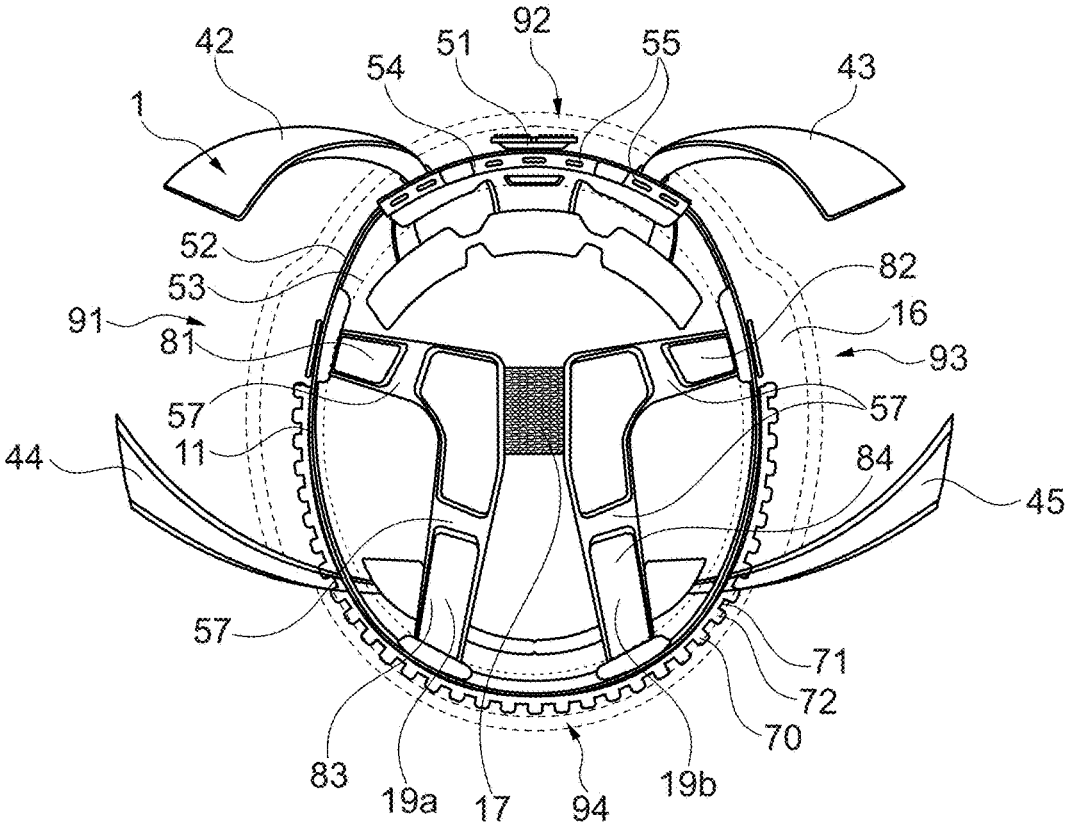

FIGS. 4*a* and 4*b* show an embodiment of a protective helmet according to the invention comprising a damping ring; and FIGS. 5*a* to 5*d* show an inner system according to the invention comprising a head net comprising a first and second flat belt.

5. DETAILED DESCRIPTION OF THE FIGURES

FIG. 1*a* shows a section of a protective helmet 1 according to the invention. The protective helmet 1 comprises (a) a dome 16, (b) an inner system 10, (c) wherein each of the adhesive elements 12*a*, 12*b*, 12*c* of the inner system is attached to the dome 16.

The inner system 10 comprises:

(a) a substantially circumferential headband 11, the circumference of the headband 11 being variably adjustable,
(b) at least a first tab 14*a*, a second tab 14*b* and a third tab 14*c*, wherein the headband 11 is connected to the at least three tabs, and
(c) at least a first adhesive element 12*a*, a second adhesive element 12*b* and a third adhesive element 12*c,* wherein the first adhesive element 12*a* is arranged to be connected to the first strap 14*a,* wherein the second adhesive element 12*b* is arranged to be connected to the second strap 14*b* and wherein the third adhesive element 12*c* is arranged to be connected to the third strap 14*c*. The second tab 14*b* and the third tab 14*c* as well as the second adhesive element 12*b* and the third adhesive element 12*c* are present in the protective helmet 1 of FIG. 1*a*, but are not shown in the view of FIG. 1*a*. However, their position is shown in the view of FIG. 1*b*. Furthermore, a fourth strap 14*d* and a fourth adhesive element 12*d* are present (see FIG. 1*b*).

The circumference of the headband 11 is adjusted by an adjustment system (see FIG. 1*b*), which is operated by a rotary knob. The headband 11 has a width of approximately 2.5 cm and is made of leather. The protective helmet is a ballistic protective helmet and has a bullet-resistant dome made of titanium. It is also possible that the dome comprises PE-titanium, aramid-titanium, PE-carbon-aramid or similar hybrid configurations. PE stands for polyethylene.

The protective helmet offers excellent balance and outstanding protection against projectiles as well as slashing and stabbing weapons. It can be manufactured in just one size and still fits the vast majority of adult wearers. The size can be adjusted very quickly and comfortably thanks to the adjustable headband.

In the example shown, all three adhesive elements 12 are glued into the spherical cap 16.

The straps 14 are attached to the headband 11 via rivets. The first tab 14*a* is attached to the headband 11 via a rivet 21. However, it is also possible to make the tabs integral with the headband 11 or to connect them to the headband 11 via a seam, for example.

The tabs 14 are elongated and thus allow a certain distance between the adhesive elements and the headband 11.

The inner system 10 can be attached to the helmet dome 16 without an engagement or reach-through element and therefore offers optimum head protection.

In this example, the first adhesive element 12*a* can be connected to the first tab 14*a* in a detachable adhesive connection, furthermore, the second adhesive element 12*b* can be connected to the second tab 14*b* in a releasable adhesive connection, furthermore, the third adhesive element 12*c* can be connected to the third tab 14*c* in a releasable adhesive connection.

However, it is also possible for the adhesive element to be connected to the tabs in a form-fit, for example via rivets.

The first tab 14*a* has a first connection point 31, wherein the headband 11 is connected to the first tab 14*a* at the first connection point 31; wherein the first tab 14*a* further has a second connection point 32, wherein the first tab 14*a* is adapted to be connected to the first adhesive member 12*a* at the second connection point 32, and wherein the first connection point 31 is spaced apart from the second connection point 32 so that the headband 11 can be floatingly attached to the first adhesive member 12*a* via the first tab 14*a*. In this example, the distance between the first connection point 31 and the second connection point 32 is approximately 4 cm. The second strap 14*b* and the third strap are correspondingly connected to the second adhesive element 12*b* and the third adhesive element 12*c*, respectively.

The detachable adhesive connections are indirect connections. Thus, the first tab 14*a* is attached to a first intermediate element 13*a* at the second connection point 32 and the first intermediate element 13*a* is attached to the first adhesive element 12*a* in a detachable adhesive connection. In this example, the first tab 14*a* is attached to the first intermediate element 13*a* at the second connection point 32 via a rivet 22. The same applies to the second 14*b* and third 14*c* tabs.

The fourth strap 14*d* is arranged in a front area of the protective helmet 1 and is Y-shaped. The fourth strap 14*d* is connected to the headband 11 at a seventh connection point (not shown). The fourth strap 14*d* is attached to the fourth intermediate element 13*d* at an eighth connection point 33 and a ninth connection point 34. The fourth intermediate element 13*d* is in turn attached to the fourth adhesive element 12*d* via a detachable adhesive connection.

Alternatively, it is possible to attach the tabs 14 to the intermediate elements 13 via a seam connection.

The detachable adhesive connection of the first adhesive element 12*a* to the first intermediate element 13*a* comprises a hook-and-loop fastener. The first adhesive element 12*a* has a hook tape, while the first intermediate element 13*a* has a corresponding loop tape. The arrangement can also be reversed. This has the advantage that the user can easily keep the components apart during assembly. The safety of not hooking anything incorrectly can also be ensured or further improved, for example, by a defined shape of the hook and loop elements.

The inner system 10 also has a head net 17, which has a large number of openings 18. The head net 17 is knitted. The head net 17 is stretched between an upper left upholstery element 19*a* and an upper right upholstery element 19*b*. The left and right upper padding elements 19*a* and 19*b* each have two ventilation channels. These are formed by a different thickness/leveling of the left/right upholstery element 19*a*, 19*b*. This has the advantage of improving ventilation and thus wearing comfort.

FIG. 1*b* shows a view from below of the protective helmet in FIG. 1*a*.

The protective helmet of FIGS. 1*a* and 1*b* has four intermediate elements 13*a* to 13*d*, four adhesive elements 12*a* to 12*d* and four straps 13*a* to 13*d*. The view in FIG. 1*b* shows the four intermediate elements 13*a* to 13*d* of the inner system 10 of the protective helmet 1. The adhesive elements 12*a* to 12*d* are present but partially concealed by the intermediate elements 13*a* to 13*d*. The adhesive elements 12*a* to 12*d* are arranged on the left 91, rear 92, right 93 and front 94, respectively, on the dome. Accordingly, the first tab 13*a* is arranged on the left 91, the second tab 13*b* is arranged at the rear 92, the third tab 13*c* is arranged on the right 93 and the fourth tab 14*d* is arranged at the front 94. The second tab 13*b* (rear 92) and the fourth tab 13*d* (front 94) are Y-shaped.

The adjustment system by means of which the circumference of the headband 11 can be adjusted is also shown. The adjustment system comprises a rotary knob 51. In this example, the headband 11 is essentially circumferential. In this example, the headband 11 is circumferential, with the exception of the adjustment mechanism. The headband 11 runs through the adjustment mechanism.

As can be seen in FIG. 1*b*, the protective helmet also has a harness system 41. The harness system 41 is attached to the dome separately from the inner system. The harness system 41 also engages around the adjustment system, which is arranged in a rear area.

The protective helmet 1 also has a front padding element 15. In the embodiment example of FIGS. 1*a* and 1*b*, the front padding element 15 is arranged in a front area of the protective helmet 1. Other or alternative positions are possible in principle and are shown in FIGS. 2 and 3.

The protective helmet 1 of FIG. 1 comprises a fitbox 54. The fitbox 54 comprises the length adjustment mechanism of the headband 11. Possible configurations of the fitbox 54 are described in more detail below. Since the lower back of the head is anatomically undercut where the fitbox 54 is located, a clamping effect is created which prevents the headband 11 and the dome 16 from detaching upwards from the head.

FIGS. 2*a* to 2*e* (together: FIG. 2) show an alternative design of a protective helmet 1. The protective helmet 1 of FIG. 2 is similar to the protective helmet 1 of FIG. 1. To avoid repetition, reference is therefore made to the above description. However, the dome 16 of the protective helmet 1 in FIG. 2 is designed differently to the dome 1 of the protective helmet 1 in FIG. 1. The dome 16 of the protective helmet 1 in FIG. 2 ensures improved protection of the particularly sensitive area around the ears, especially behind the ears, as it extends significantly lower over the wearer's ears. The protective helmet 1 of FIG. 2 comprises a fitbox 54. The fitbox 54 comprises the length adjustment mechanism of the headband 11. Possible configurations of the fitbox 54 are described in more detail below. The fitbox 54 comprises two retaining tabs 56*a*, 56*b* for a left rear strap 42 and a right rear strap 43 of a harness system.

Figure 2A:
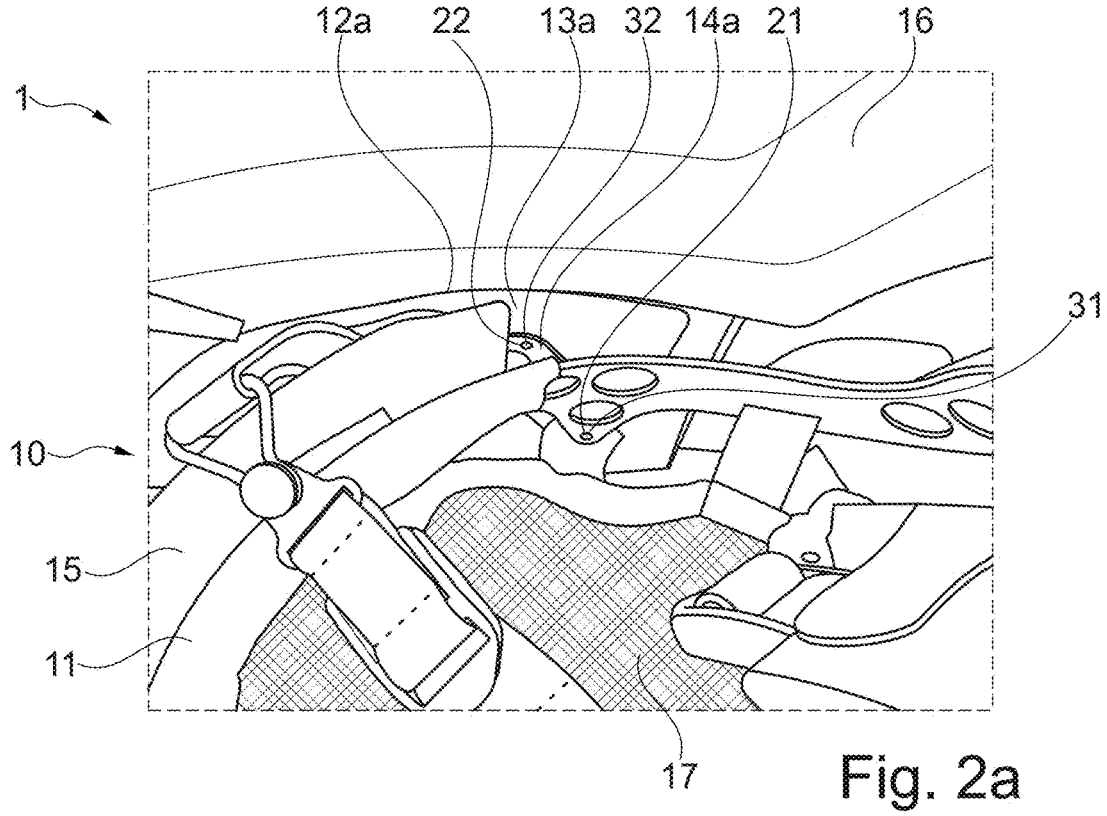
Figure 2B:
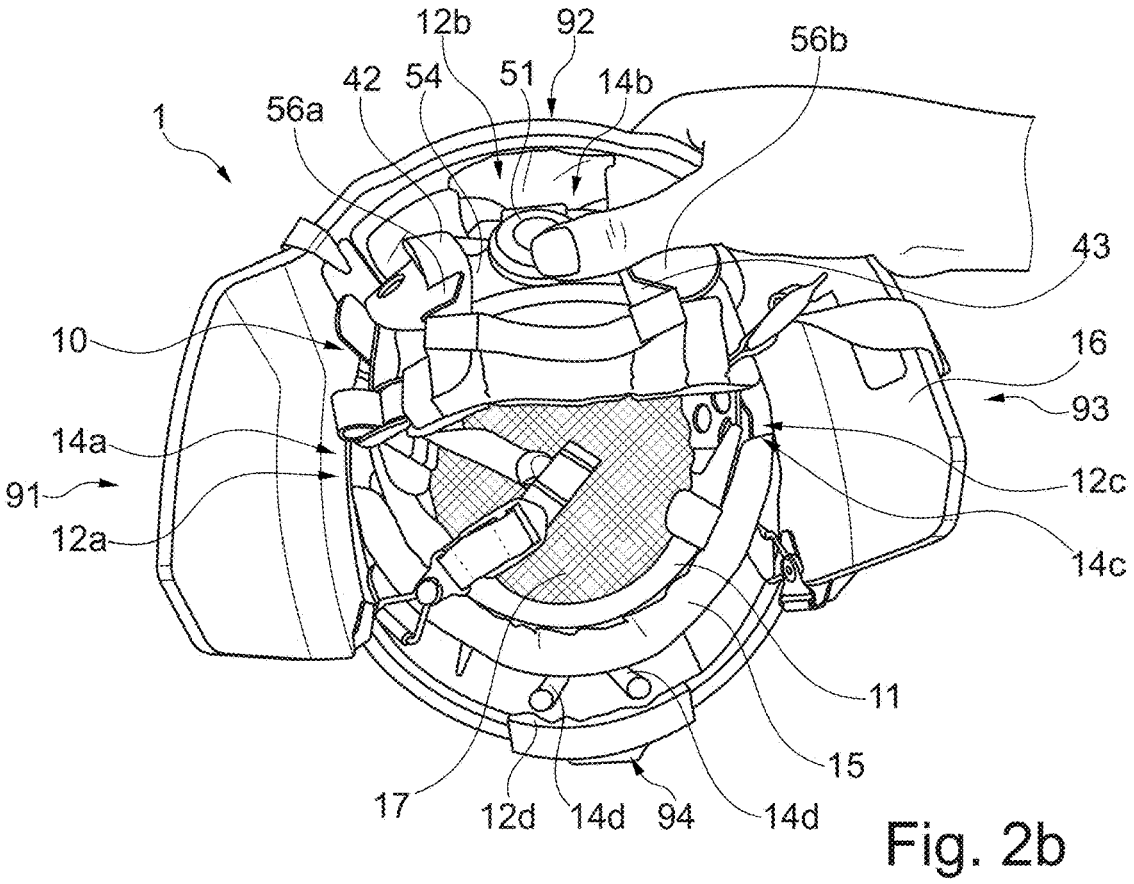
Figure 2C:
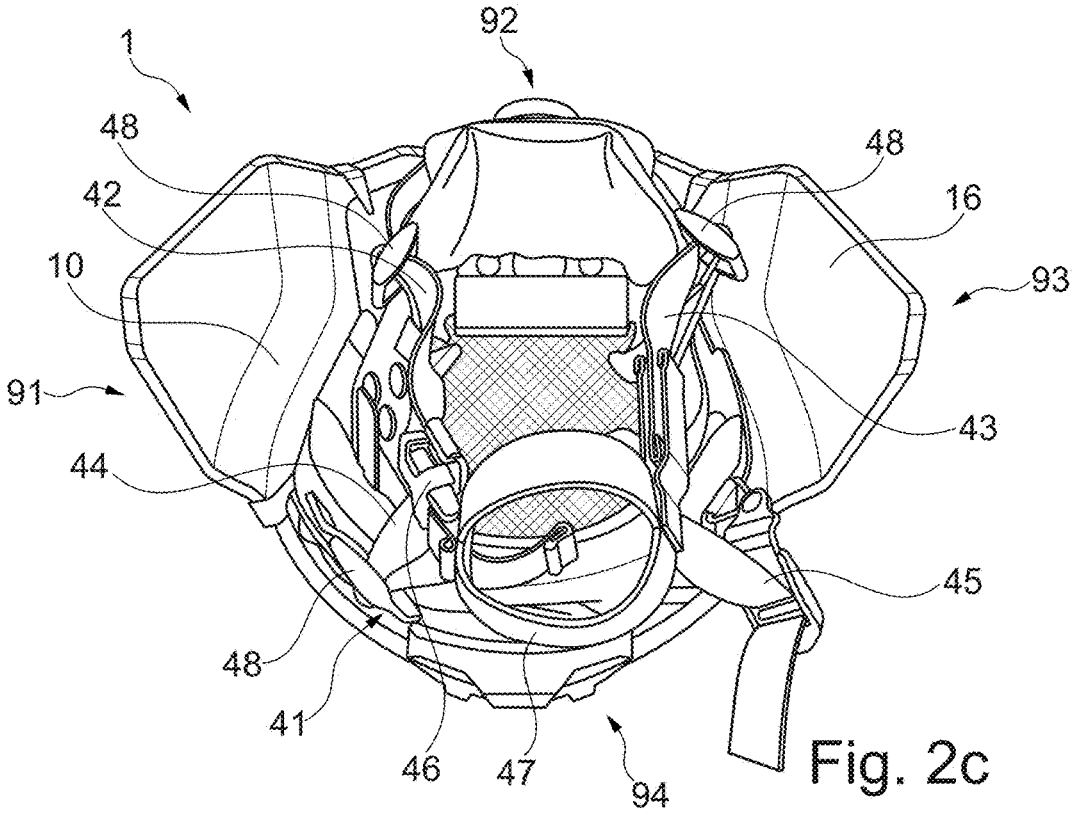
Figure 2D:
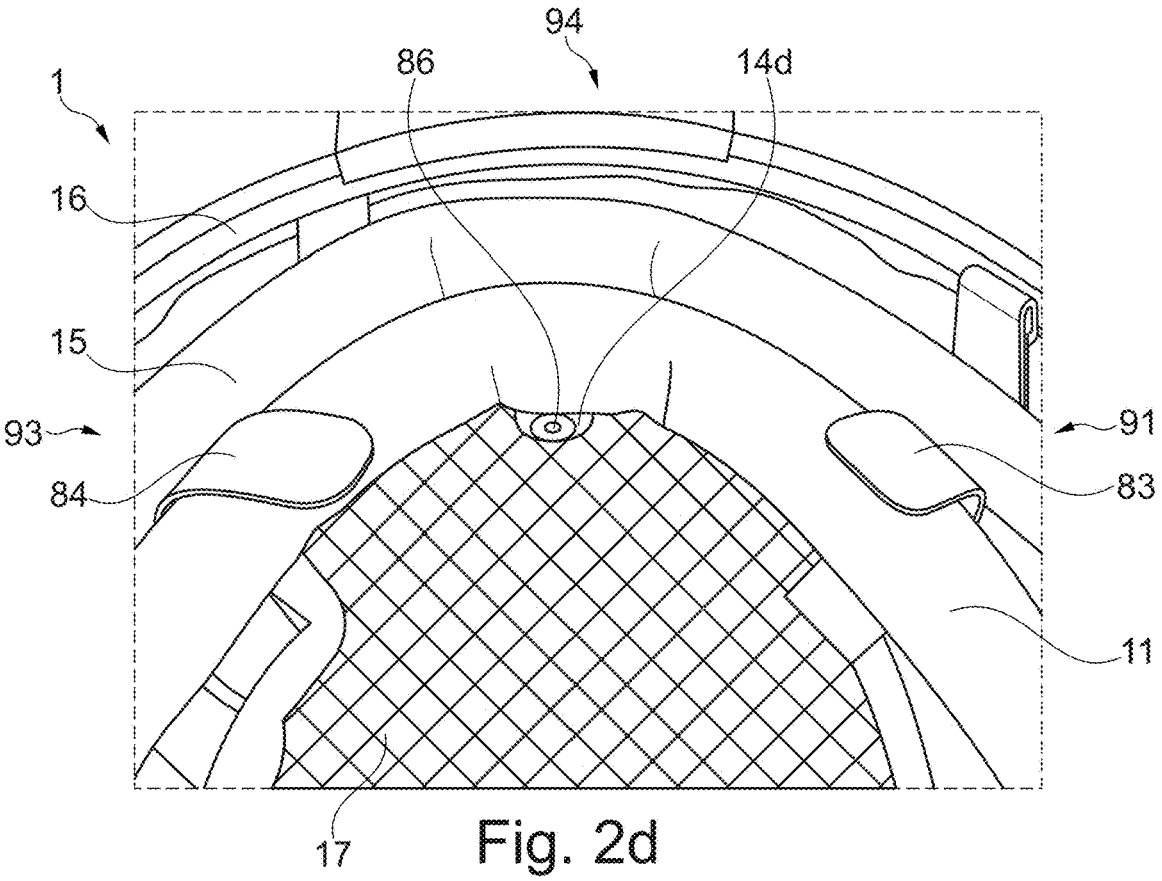

FIG. 2*c* shows the harness system 41 of the protective helmet 1. The exemplary harness system 41 comprises:

(a) a left rear strap 42, (b) a right rear strap 43, (c) a left front strap 44, (d) a right front strap 45, and (e) a chin portion 47 in which the left rear strap 42, the right rear strap 43, the left front strap 44 and the right front strap 45 are releasably connected to each other so that the harness system can be opened.

In this example, the detachable connection for opening the harness system is effected by a fastener 46, in this case: a buckle 46. The length of the left rear strap 42, the right rear strap 43, the left front strap 44, and the right front strap 45 can be adjusted. This ensures an optimum fit. In this example, the length can be adjusted using a buckle 48 in each case.

The first adhesive element 12*a* and the corresponding first strap 14*a* are arranged on a left side 91 of the protective helmet 1. The second adhesive element 12*b* and the corresponding second strap 14*b* are arranged at the rear 92 of the hard hat 1. The third adhesive element 12*c* and the corresponding third strap 14*c* are arranged on a right-hand side 93 of the protective helmet 1. A fourth adhesive element and a corresponding fourth strap are arranged at the front 94 of the protective helmet 1 (see FIG. 2*b*).

The inner system 10 has a head net 17. The head net 17 is attached directly to the dome 16 via a first head net fastening element 81 and a second head net fastening element 82. In this example, the fastening comprises a hook-and-loop fastener. "Directly" in this context means that the first 81 and second 82 head net fastening elements are fastened directly to the dome 16 (i.e. not only via intervening objects such as the headband 11). The headband 11 is not a head net fastening element.

Figure 2E:
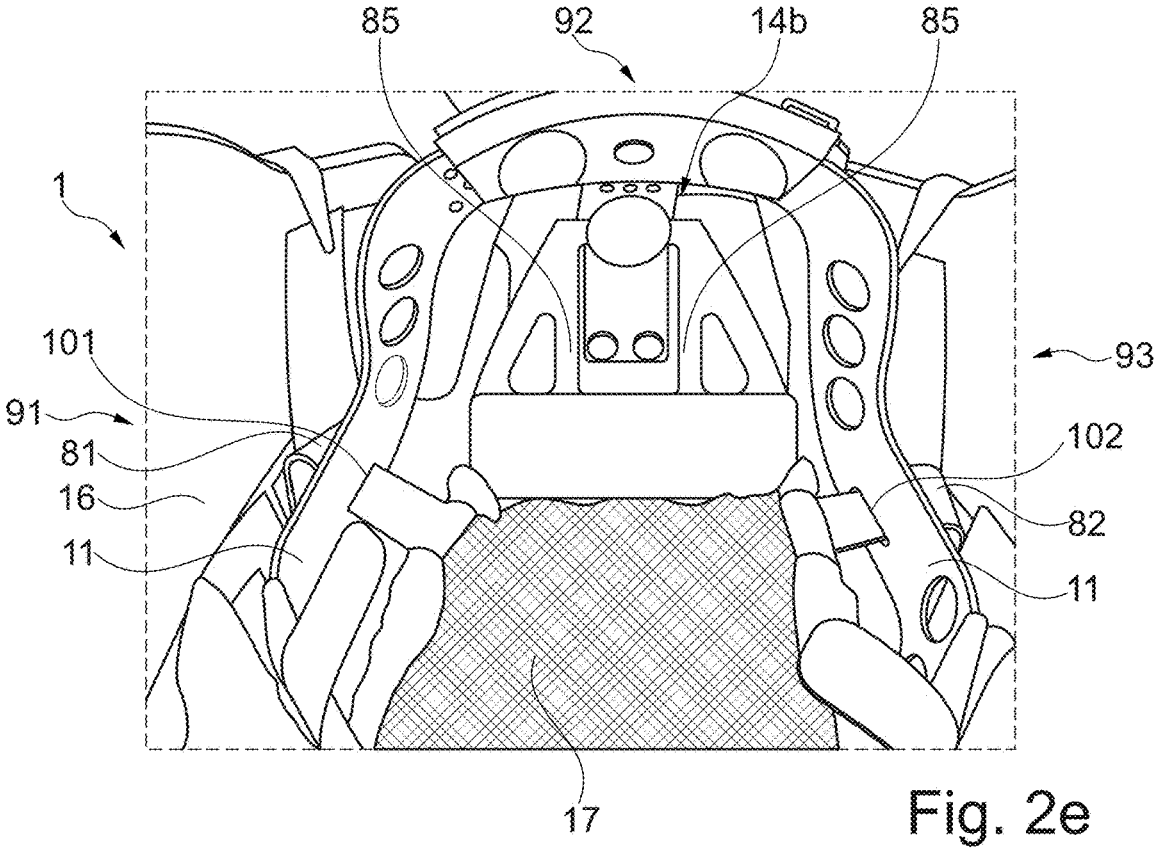

The head net 17 is attached to a left side 91 of the dome 16 via a first head net fastening element 81 and attached to a right side 93 of the dome 16 via a second head net fastening element 82 (see FIG. 2*e*). The first 81 and second 82 head net fastening elements pass—respectively—through a first and second opening, in the form of a gap, in the headband 11 (see FIG. 2*e*).

In this example, the head net 17 is additionally fastened to the pad 15 and the headband 11 via a third head net fastening element 83 on the left side 91 of the protective helmet 1. In this example, the head net 17 is additionally attached to the pad 15 and the headband 11 via a fourth head net attachment element 84 on the right side 93 of the protective helmet 1 (see FIG. 2*d*). In other words, in this example, the third head net fastening element 83 and the fourth head net fastening element 84 connect the head net 17 indirectly to the dome 16 via the headband 11. In this example, the fastening comprises a hook-and-loop fastener.

However, it is also possible, without changing the third 83 and fourth 84 fastening elements, that the head net 17 is fastened directly to the dome 16 on a left side 91 and is fastened directly to the dome 16 via a fourth head net fastening element 84 on a right side 93.

The head net 17 is attached to the second tab 14*b* (rear 92) via a suspension 85 (see FIG. 2*e*). The head net 17 is attached directly to the fourth tab 14*d* (front 94) via a rivet 86 (see FIG. 2*d*). However, other types of attachment are also possible.

FIG. 3*a* shows a rear view from the back to the front of a protective helmet 1 according to the invention. FIG. 3*b* shows a front view of the protective helmet 1 of FIG. 3*a* and FIG. 3*c* shows a top view from above of the protective helmet 1 of FIGS. 3*a* and 3*b*. The protective helmet of FIGS. 3*a* to 3*g* is similar to that of FIGS. 1*a* and 1*b*, particularly with regard to the inner system 11 and its attachment to the dome 16.

FIGS. 3*a* to 3*d* show in particular the harness system 41 of the protective helmet. The exemplary harness system 41 comprises:

(a) a left rear strap 42, (b) a right rear strap 43, (c) a left front strap 44, (d) a right front strap 45, and (e) a chin area in which the left rear strap 42, the right rear strap 43, the left front strap 44 and the right front strap 45 are releasably connected to each other so that the harness system can be opened.

The harness system 41 is connected to the dome 16 via a detachable adhesive connection, in this example a hook-and-loop connection. The harness system 41 is connected to the dome 16 separately from the inner system 11. However, it is also possible that the harness system 41 is connected to the dome 16 at one or more identical points as the inner system 11.

FIGS. 3*a* to 3*g* show that the headband 11 is essentially circumferential. In particular, FIG. 3*c* illustrates a first circumference 52 and a smaller second circumference 53 of the headband 11. As can be seen, the headband is shortened by adjusting the circumference of the headband 11 from all sides. Due to the advantageous inner system, the head remains centered even with the smaller circumference 53 and is not displaced forward-unlike with inner systems from the prior art.

FIG. 3*c* also shows the fitbox 54, on which the rotary knob 51 for adjusting the length of the headband 11 is mounted. In this example, the fitbox 54 is constructed in two parts. This has the advantage that the headband 11 with the width adjustment can be fitted easily using the rotary knob. The fitbox 54 can be opened for this purpose, the headband 11 can be arranged in the fitbox 54 in a second step and finally the fitbox 54 is closed.

The fitbox 54 also has a large number of drainage holes 55. In this example, there are seven drainage holes 55, of which only two have been provided with the reference sign 55 as an example. During intensive use, dirt often collects inside the fitbox 54. In order to prevent damage or blockage of the length adjustment mechanism, the fitbox 54 can be cleaned with water or cleaning agents. The drainage holes 55 are used to drain the water and/or cleaning agent. This improves the service life and reliability of the fitbox 54 and the length adjustment mechanism it contains.

FIG. 3*d* illustrates the operation of the rotary knob 51 for adjusting the length of the headband 11. Retaining tabs 56*a*, 56*b* are arranged on the fitbox 54 on one left and one right side of the rotary knob. This has the advantage that the left rear strap 42 can be ergonomically guided around the fitbox 54 by the retaining tab 56*a* and the right rear strap 43 by the retaining tab 56*b*. This improves the wearing comfort and fit of the helmet.

FIG. 3*e* shows part of the length adjustment mechanism 61 of the fitbox 54. The length adjustment mechanism 61 comprises an inner wheel 62, which is arranged in a receptacle 63. The holder 64 comprises a fine grating at one edge area. When the rotary knob 51 is actuated, the wheel 62 rotates, which causes the length of the headband 11 to be adjusted. The arrows illustrate an extension of the headband, which is effected evenly on all sides around the head so that the wearer's head always remains centered.

FIG. 3*f* shows an inner view of the protective helmet 1. The protective helmet 1 comprises a left 19*a* and right 19*b* upper padding element, which is arranged over the head when worn. A head net 17 is stretched between the left 19*a* and right 19*b* upper padding element.

The left and right padding elements 19*a*, 19*b* are attached to the headband 11 with a hook-and-loop fastener. However, another type of fastening is possible. Adjusting the length of the headband 11 therefore also affects the left and right padding elements 19*a*, 19*b*. The harness system 41 described above is also indirectly connected to the headband 11. Thus, the rear left strap 42 and the rear right strap 43 are guided around the fitbox 54 via retaining tabs 56*a*, 56*b*.

The inner system 10 has a head net 17. The head net 17 is attached directly to the dome 16 via a first head net fastening element 81 on a left side 91 and a second head net fastening element 82 on a right side 93. In this example, the head net 17 is additionally attached directly to the dome 16 via a third head net attachment element 83 on a left side 91 and is attached directly to the dome 16 via a fourth head net attachment element 84 on a right side 93.

In this example, the attachment comprises a hook and loop fastener. "Directly" in this context means that the first 81, second 82, third 83 and fourth 84 head net fastening elements are attached directly to the dome 16 (i.e. not just via intervening objects such as the headband 11). The headband 11 is not a head net fastening element.

The first 81, second 82, third 83, and fourth 84 head net fastening element can, for example—respectively—pass through a first, second, third, fourth opening, in the form of a gap, in the headband 11.

If the headband is shortened (as indicated by the arrows), the headband also pushes the head downwards from above and upwards from below and therefore remains centered in the vertical direction. This improves the protective effect of the protective helmet 1.

FIG. 3*g* shows that the protective helmet 1 also has a rear padding element 20 and a front padding element 15. The front padding element 20 protects the wearer's forehead from injury and is attached to the headband 11 with a hook-and-loop fastener. The rear padding element 20 is also attached to the headband 11 with a hook-and-loop fastener. A different type of fastening is possible.

FIGS. 4*a* and 4*b* (together: FIG. 4) show an alternative protective helmet 1 that is similar to the protective helmet 1 in FIG. 3. Unlike the protective helmet 1 in FIG. 3, the protective helmet in FIG. 4 has an additional shock absorber ring 70.

FIG. 4*a* is similar to FIG. 3*a*. FIG. 4*b* is similar to FIG. 3*c*. FIGS. 4*a* and 4*b* show a damper ring 70, which is arranged over a part of the headband 11 (see FIG. 4*b*). The damper ring 70 comprises a plurality of ventilation cams 71 and projections 72, which are arranged alternately. In this example, the damper ring 70 comprises a foam material, for example ethylene-vinyl acetate copolymers, EVA.

The shock absorber ring 70 significantly improves the wearing comfort and increases the protective effect of the protective helmet 1. The shock absorber ring 70 is attached to the headband 11 so that it is always ensured that the shock absorber ring 70 covers the headband 11 even when the helmet is adjusted by adjusting the length of the headband. In this example, the fastening comprises a hook-and-loop fastener.

FIGS. 5*a* to 5*d* show an inner system 10 according to the invention, which comprises a first 111 and second 112 flat band. The inner system 10 is for a protective helmet. The dome is not shown in order to better illustrate some details of the inner system.

The inner system 10 comprises:

(a) a substantially circumferential headband 11, the circumference of the headband 11 being variably adjustable, (b) at least a first tab, a second tab and a third tab, wherein the headband 11 is connected to the at least three tabs, and (c) at least a first adhesive element 12*a*, a second adhesive element 12*b* and a third adhesive element 12*c*, wherein the first adhesive element 12*a* is arranged to be connected to the first tab, wherein the second adhesive element 12*b* is arranged to be connected to the second tab and wherein the third adhesive element 12*c* is arranged to be connected to the third tab. Furthermore, a fourth tab and a fourth adhesive element 12*d* are provided.

Figure 5A:
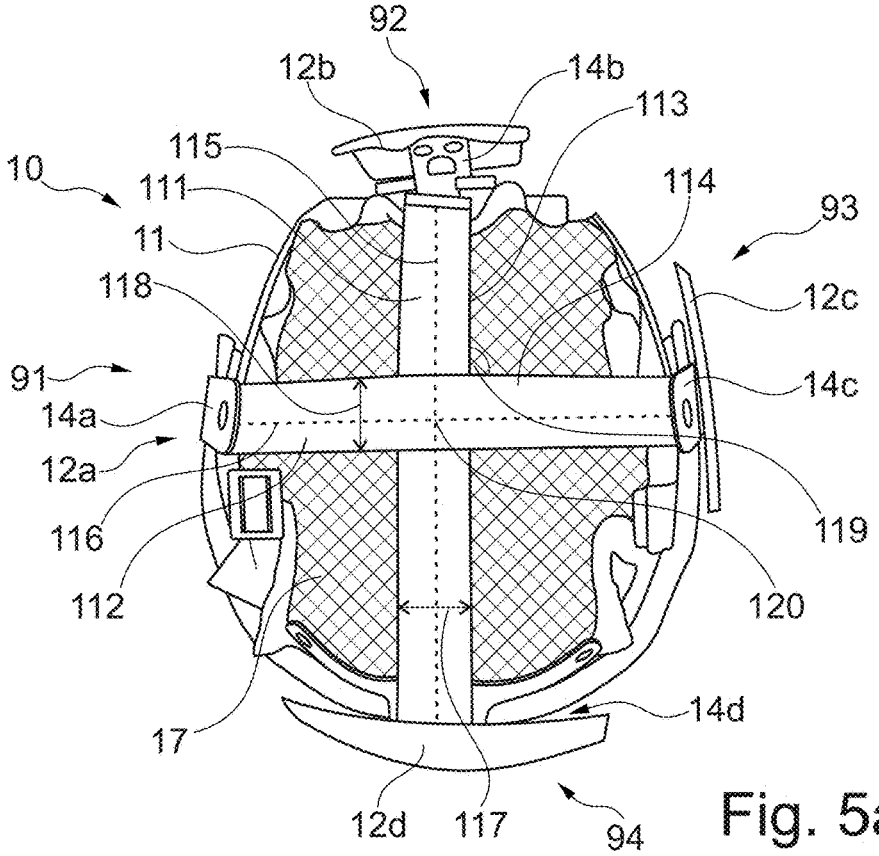
Figure 5B:
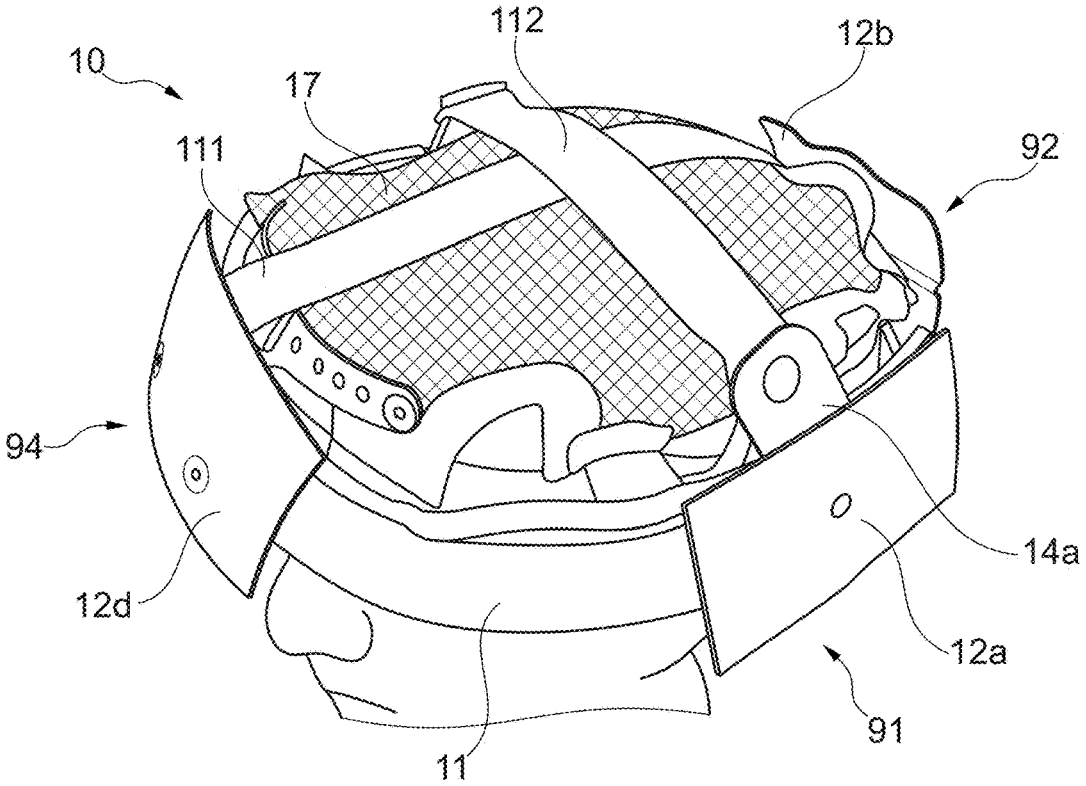

FIG. 5*a* shows a view from above. FIG. 5*b* shows a perspective view from the front. The first adhesive element 12*a* and the corresponding first tab are arranged on a left side 91 of the inner system 10. The second adhesive element 12*b* and the corresponding second tab are arranged at the rear 92 of the inner system 10. The third adhesive element 12*c* and the corresponding third tab are arranged on a right-hand side 93 of the inner system 10. A fourth adhesive element and a corresponding fourth tab are arranged at the front 94 of the inner system 10.

The inner system comprises a head net 17, which can be attached in various ways to the headband 11 and/or to a dome of a protective helmet.

The head net comprises a flat band 111, 112. In this example, the head net comprises a first 111 and a second 112 flat band, wherein the first flat band 111 and the second flat band 112 are arranged substantially perpendicular to each other. In this example, two intersecting edges of the first 111 and second 112 flat bands form an angle $\alpha$ 119 of about 85° to 95°. However, the angle $\alpha$ 119 can also be between 45° and 135°, for example.

The flat bands 111, 112 comprise a textile whose width 117, 118 is considerably greater than its thickness. In this case, the first flat band 111 has a first width 117 of approximately 2 cm. In this case, the second flat band 112 comprises a second width 118 of about 2 cm. The first 111 and second 112 flat bands are only 1-2 mm thick. The flat bands 111, 112 are arranged in the apex region.

The first flat band 111 comprises a first longitudinal axis 115. The second flat band 112 comprises a second longitudinal axis 116. The first 111 and second 112 flat bands improve positioning of the head along these two longitudinal axes 115, 116. In particular, the flat bands 111, 112 angle centrally so that positioning is thereby improved.

The first longitudinal axis 115 runs substantially from a front 94 to a rear 92. The second longitudinal axis 116 runs substantially from a right side 93 to a left side 91. Substantially means within the scope of variations customary in the art for soft components of inner systems for protective helmets, comprising variations of about 20°.

The first 111 and second 112 flat strips intersect at a central intersection 120.

Figure 5C:
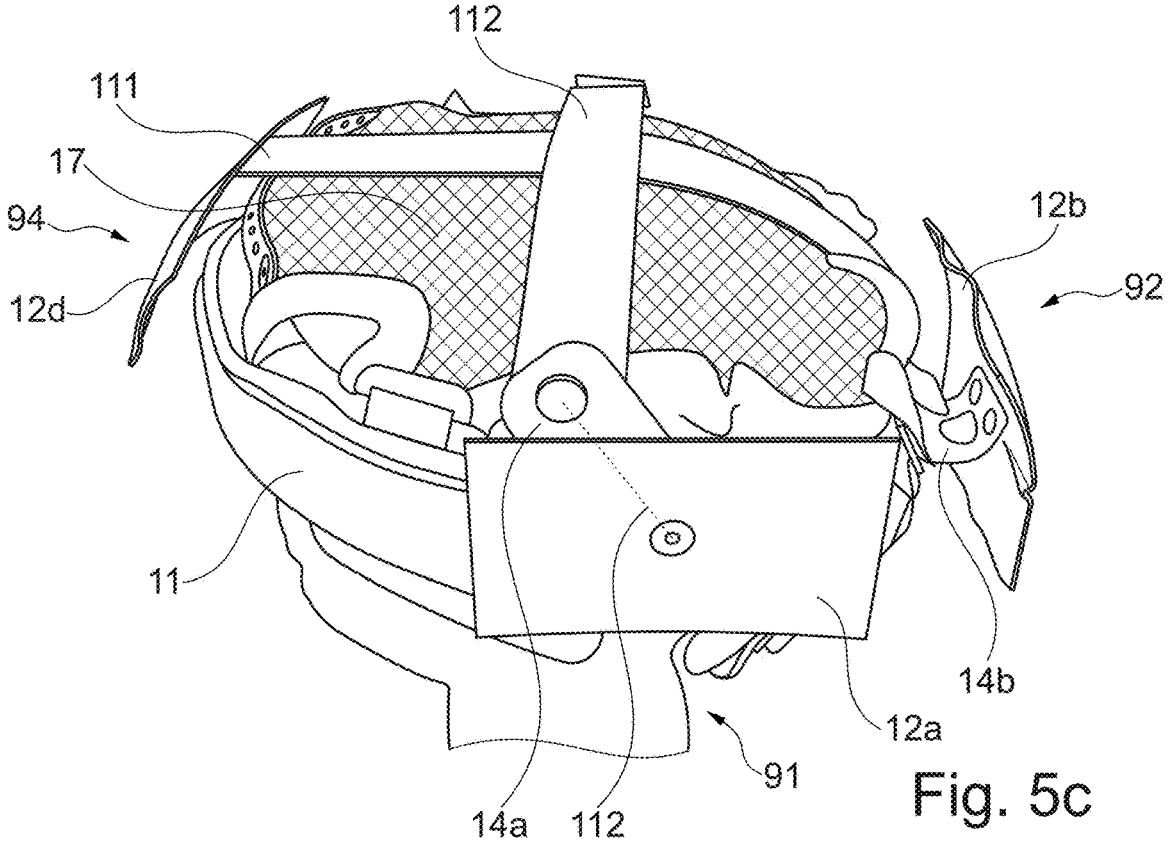
Figure 5D:
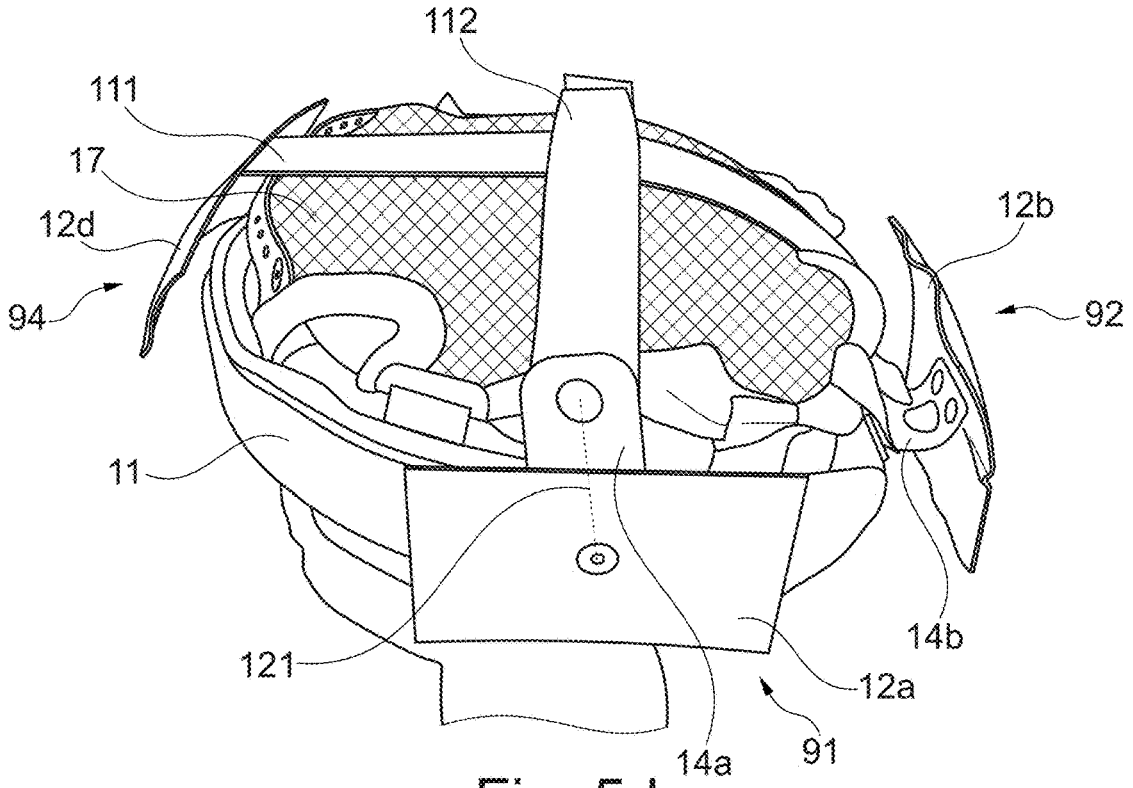

FIGS. 5*c* and 5*d* illustrate the excellent balance (an example of best balance) of the inner system 10 according to the invention. The imaginary line 121 serves to illustrate the position of the inner system in two different positions.

FIG. 5*c* shows a first (original) position of the inner system in which the adhesive element 12*a* is displaced backwards 92.

FIG. 5*d* shows a second (greatly exaggerated) position of the inner system in which the adhesive element 12*a* is displaced far forward 94.

Due to the weight of the dome, the dome tends to orient itself towards the front 94 via the lever arrangement of the side tabs 14*a*, 14*c*. The straps 14*a* to 14*d* attached to the headband 11 ensure that the helmet dome is always positioned centrally on all sides during any size adjustment. This is particularly important if the inner system is attached to the helmet dome via adhesive elements, as this type of attachment requires particularly good centering. Only a few possible embodiments of the invention have been described above by way of example. It should be understood that these exemplary embodiments can be modified and combined with each other in a variety of ways if they are compatible, and that certain features can be omitted if they appear to be dispensable.

The scope of protection is determined by the patent claims and is not limited by the embodiments.

REFERENCE SIGNS

1 protective helmet
10 inner system
11 headband
12*a*, 12*b*, 12*c*, 12first second, third, fourth adhesive element
13*a*, 13*b*, 13*c*, 13first second, third, fourth intermediate element
14*a*, 14*b*, 14*c*, 14first second, third, fourth tab
15 front padding element
16 dome
17 head net
18 opening
19*a* left upper padding element
19*b* right upper padding element
20 rear padding element
21 rivet
22 rivet
31 first connection point
32 second connection point
33 eighth connection point
34 ninth connection point
41 harness system
42 left rear strap
43 right rear strap
44 left front strap
45 right front strap
46 buckle
47 chin area
48 buckle
51 rotary knob
52 first circumference
53 second circumference
54 fitbox
55 drainage holes
56 retaining tabs
57 ventilation duct
61 length adjustment mechanism
62 inner cog
63 receptacle
64 fine grating
70 damper ring
71 ventilation cam
72 projection
81 first head net fastening element
82 second head net fastening element
83 third head net fastening element
84 fourth head net fastening element
85 suspension
86 riveting
91 left side
92 rear
93 right side
94 front
101 first opening
102 second opening
111 first flat belt
112 second flat band
113 first edge
114 second edge
115 first longitudinal axis
116 second longitudinal axis
117 first width
118 second width
119 angle
120 intersection
121 imaginary line

The invention claimed is:

1. An inner system for a protective helmet, comprising:
(a) a substantially circumferential headband, the circumference of the headband being variably adjustable,
(b) at least a first, a second and a third tab, wherein the headband is connected to the at least three tabs, and
(c) at least a first, a second and a third adhesive element,
wherein the first adhesive element is adapted to be connected to the first tab,
wherein the second adhesive element is arranged to be connected to the second tab,
wherein the third adhesive element is arranged to be connected to the third tab,
wherein the first tab has a first connection point,
wherein the headband is connected to the first strap at the first connection point,
wherein the first tab further comprises a second connection point,
wherein the first tab is adapted to be connected to the first adhesive element at the second connection point,
wherein the first connection point is spaced apart from the second connection point so that the headband is operable to be attached to the first adhesive element in a floating manner via the first tab, and
wherein the first tab is attached to a first intermediate element at the second connection point, and wherein the first intermediate element is operable to be attached to the first adhesive element in a releasable adhesive connection, so that the first tab is operable to be indirectly attached to the first adhesive element in a releasable adhesive connection.

2. The inner system according to claim 1, wherein the first adhesive element is operable to be connected to the first tab in a releasable adhesive connection,
wherein the second adhesive element is operable to be connected to the second tab in a releasable adhesive connection, and
wherein the third adhesive element is operable to be connected to the third tab in a releasable adhesive connection.

3. The inner system according to claim 1, wherein the circumference of the headband is operable to be adjusted by an adjustment system and wherein the adjustment system is actuated by a rotary knob.

4. The inner system according to claim 1, wherein the releasable adhesive connection of the first and/or the second and/or the third adhesive element comprises a hook-and-loop fastener.

5. The inner system according to claim 1, further comprising a head net.

6. A protective helmet, comprising:
a dome, and an inner system having:

a substantially circumferential headband, the circumference of the headband being variably adjustable, a first, a second and a third tab, wherein the headband is connected to the at least three tabs; and a first, a second and a third adhesive element;

wherein the first adhesive element is adapted to be connected to the first tab;

wherein the second adhesive element is arranged to be connected to the second tab;

wherein the third adhesive element is arranged to be connected to the third tab;

wherein each of the adhesive elements of the inner system is attached to the dome;

wherein the first tab has a first connection point;

wherein the headband is connected to the first strap at the first connection point;

wherein the first tab further comprises a second connection point;

wherein the first tab is adapted to be connected to the first adhesive element at the second connection point;

wherein the first connection point is spaced apart from the second connection point so that the headband is operable to be attached to the first adhesive element in a floating manner via the first tab; and wherein the first tab is attached to a first intermediate element at the second connection point, and wherein the first intermediate element is operable to be attached to the first adhesive element in a releasable adhesive connection, so that the first tab is operable to be indirectly attached to the first adhesive element in a releasable adhesive connection.

7. The protective helmet according to claim 6, wherein each of the adhesive elements is attached to the dome via an adhesive connection.

8. The protective helmet according to claim 6, further comprising a harness system, wherein the harness system is attached to the dome via a detachable adhesive connection.

9. The protective helmet according to claim 8, wherein the harness system comprises:

(a) a left rear strap, (b) a right rear strap, (c) a left front strap, (d) a right front strap, and (e) a chin area in which the left rear strap, the right rear strap, the left front strap and the right front strap are releasably connected to each other so that the harness system can is operable to be opened.

10. The protective helmet according to claim 6, wherein the dome comprises titanium, polyethylene-titanium, aramid-titanium, and/or a polyethylene-carbon-aramid material.

* * * * *